US011807476B2

(12) United States Patent
Akiyama

(10) Patent No.: US 11,807,476 B2
(45) Date of Patent: Nov. 7, 2023

(54) SHEET FEEDING APPARATUS

(71) Applicant: Hiroto Akiyama, Yamanashi-ken (JP)

(72) Inventor: Hiroto Akiyama, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 210 days.

(21) Appl. No.: 17/130,747

(22) Filed: Dec. 22, 2020

(65) Prior Publication Data

US 2021/0198060 A1 Jul. 1, 2021

(30) Foreign Application Priority Data

Dec. 27, 2019 (JP) ..... 2019-239939

(51) Int. Cl.
*B65H 1/26* (2006.01)
*B65H 3/06* (2006.01)

(52) U.S. Cl.
CPC ..... *B65H 1/266* (2013.01); *B65H 3/0684* (2013.01); *B65H 2404/1442* (2013.01); *B65H 2405/32* (2013.01); *B65H 2601/11* (2013.01); *B65H 2601/325* (2013.01)

(58) Field of Classification Search
CPC ... B65H 3/54; B65H 3/56; B65H 2405/11425
See application file for complete search history.

(56) References Cited

U.S. PATENT DOCUMENTS

| | | | | |
|---|---|---|---|---|
| 6,695,303 | B2 | 2/2004 | Okada et al. | |
| 7,267,333 | B2 * | 9/2007 | Kawachi | F16H 27/08 271/116 |
| 7,422,205 | B2 | 9/2008 | Akiyama et al. | |
| 9,617,093 | B2 * | 4/2017 | Okada | B65H 3/0669 |
| 9,643,807 | B2 * | 5/2017 | Ishikawa | B65H 7/02 |
| 10,392,208 | B2 * | 8/2019 | Yoshida | B65H 1/266 |
| 11,339,016 | B2 * | 5/2022 | Sugita | B65H 3/0684 |
| 2021/0130119 | A1 * | 5/2021 | Migita | B65H 3/0684 |

FOREIGN PATENT DOCUMENTS

| | | | |
|---|---|---|---|
| JP | 2000-203728 | A | 7/2000 |
| JP | 2001-139165 | A | 5/2001 |
| JP | 2002-274675 | A | 9/2002 |
| JP | 2005-303610 | A | 10/2005 |
| JP | 2010-100349 | A | 5/2010 |
| JP | 2015-221707 | A | 12/2015 |

* cited by examiner

*Primary Examiner* — Patrick Cicchino
(74) *Attorney, Agent, or Firm* — Manabu Kanesaka

(57) ABSTRACT

There is provided a sheet feeding apparatus for feeding a sheet. The sheet feeding apparatus includes: a feeding roller that feeds a sheet; and a moving mechanism that moves the feeding roller to a feeding position where the feeding roller contacts the sheet, to a first retracting position where the feeding roller is separated from the sheet, and to a second retracting position lying between the feeding position and the first retracting position.

7 Claims, 16 Drawing Sheets

SHEET FEEDING APPARATUS

BACKGROUND OF THE INVENTION

Field of the Invention

The present invention relates to a sheet feeding apparatus provided with a sheet storage part for storing sheets.

Description of Related Art

As a sheet feeding apparatus for feeding sheets, JP2005-303610A describes a configuration in which a delivery roller as a sheet feeding means moves between a feeding position for feeding a sheet and a retracting position retracting from the feeding position. In the configuration described in JP2005-303610A, drive of the delivery roller itself and drive for moving the delivery roller are performed using the same drive source. In this apparatus, when the delivery roller is to be moved to the feeding position, the drive source is driven in a direction that a sheet is fed by the delivery roller.

When the drive source is driven in a direction that a sheet is fed by the delivery roller so as to move the delivery roller to the feeding position as described above, the sheet is fed at the same time when the delivery roller abuts against the sheet. At this time, the abutting pressure of the delivery roller against the sheet becomes unstable. This may cause positional displacement of the sheet being fed to result in a sheet feeding failure.

SUMMARY OF THE INVENTION

A sheet feeding apparatus according to the present invention includes: a feeding roller that feeds a sheet; and a moving mechanism that moves the feeding roller to a feeding position where the feeding roller contacts the sheet, to a first retracting position where the feeding roller is separated from the sheet, and to a second retracting position lying between the feeding position and the first retracting position.

DETAILED DESCRIPTION OF THE PREFERRED EMBODIMENT

An embodiment of the present invention will be described with reference to FIGS. 1 to 17. First, an image forming system according to the present embodiment will be described with reference to FIG. 1.

Figure 1:
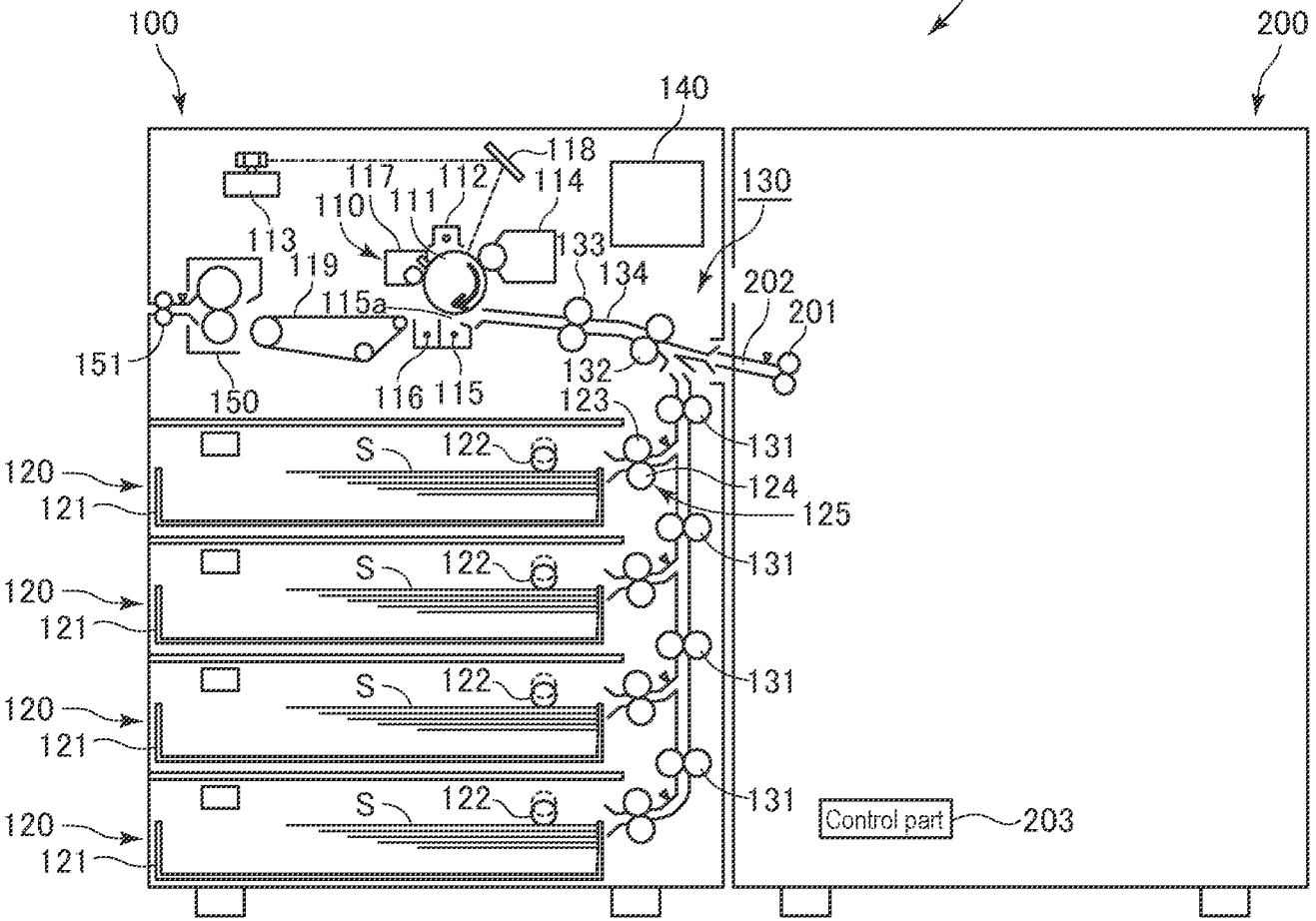
FIG. 1 is a cross-sectional view schematically illustrating the configuration of an image forming system.
Figure 2:
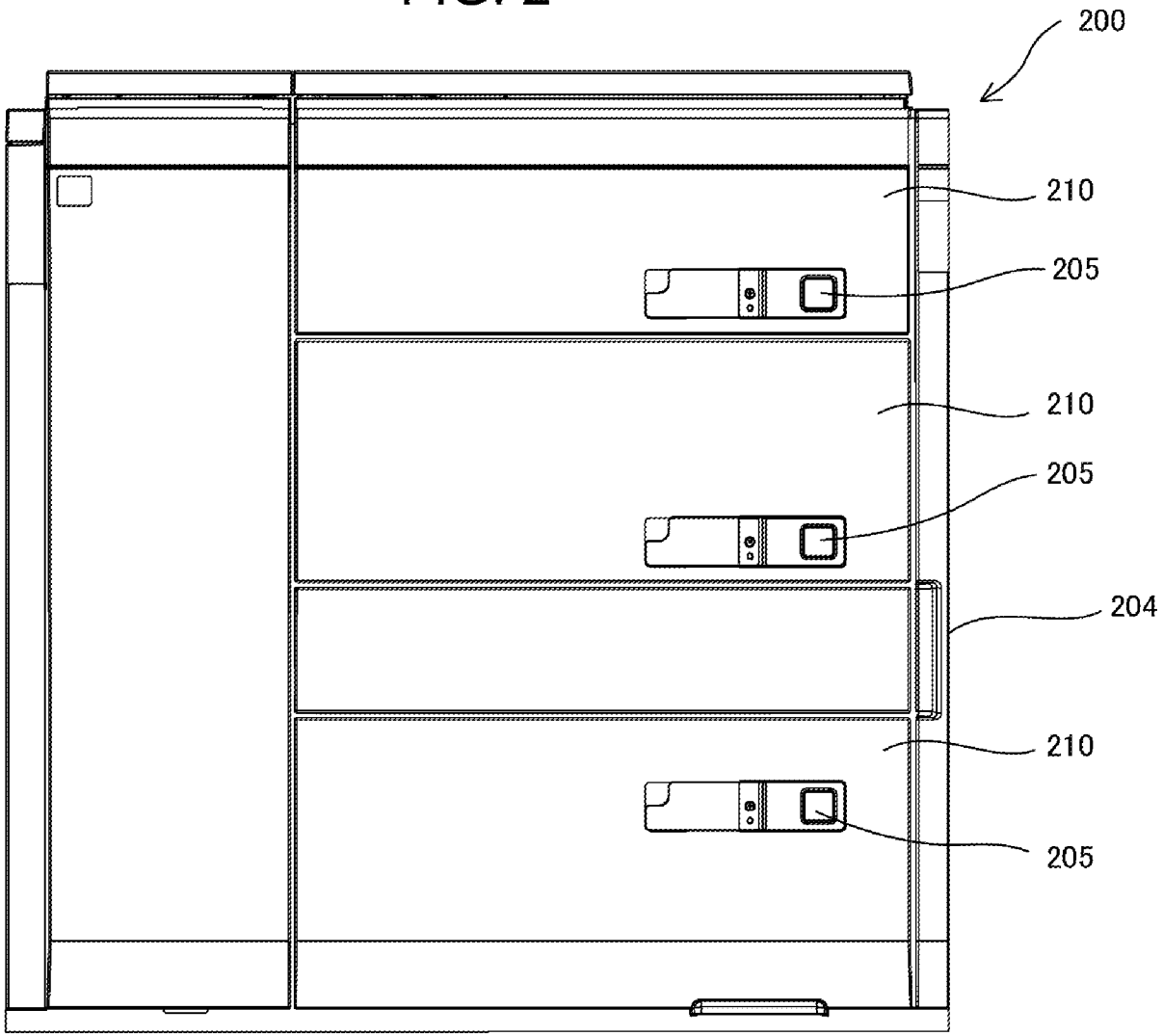
FIG. 2 is a front view of a multi-stage feeder.

FIG. 1 is a cross-sectional view schematically illustrating an example of an image forming system according to the present embodiment which is provided with a multi-stage feeder and an image forming apparatus. Hereinafter, an electrophotographic laser printer system (hereinafter, referred to merely as "printer") is taken as an example of an image forming apparatus having an image forming part. The image forming apparatus constituting the image forming system is not limited to a printer, but may be a copier, a fax machine, or a multifunction machine. Further, the image forming apparatus is not limited to of an electrophotographic type, but may be of other types such as an inkjet system.

An image forming system 1000 according to the present embodiment has an image forming apparatus 100 and a multi-stage feeder 200 as a sheet feeding apparatus connected to the image forming apparatus 100. Although details will be described later, the multi-stage feeder 200 has a plurality of storage cases each capable of storing a plurality of sheets, and the sheets can be fed from each of the storage cases to the image forming apparatus 100. Examples of the sheet include a paper sheet such as a plain paper, a thin paper, or a cardboard, and a plastic sheet.

The image forming apparatus 100 forms a toner image on a sheet according to an image signal from a document reading apparatus (not illustrated) connected to the main body thereof or a host device such as a personal computer communicably connected thereto.

The image forming apparatus 100 has an image forming part 110, a plurality of sheet feeding units 120, a sheet conveying unit 130, and other components. The components of the image forming apparatus 100 are each controlled by a control part 140. The control part 140 has a CPU (Central Processing Unit), a ROM (Read Only Memory), and a RAM (Random Access Memory). The CPU controls the components while reading a program corresponding to a control procedure stored in the ROM. The RAM stores therein work data or input data, and the CPU performs control according to the above-mentioned program while referring to the above data stored in the RAM.

The plurality of sheet feeding units 120 each have a cassette 121 for storing sheets S, a pickup roller 122, and a separating and conveying roller pair 125 constituted of a feeding roller 123 and a retard roller 124. The sheets S stored in the cassette 121 are fed one by one by the pickup roller 122 rotating while moving up and down at a predetermined timing and the separating and conveying roller pair 125.

The sheet conveying unit 130 has a conveying roller pair 131, a pre-registration roller pair 132, and a registration roller pair 133. The sheet S fed from the sheet feeding unit 120 is made to pass through a sheet conveyance path 134 by the conveying roller pair 131 and pre-registration roller pair 132 and is then guided to the registration roller pair 133. Then, the sheet S is fed to the image forming part 110 at a predetermined timing by the registration roller pair 133.

A sheet conveyed from the multi-stage feeder 200 to be described later through a conveying roller pair 201 is then conveyed to the image forming apparatus 100 through a connection path 202 connecting the multi-stage feeder 200 and the image forming apparatus 100. Like the sheet conveyed from the sheet feeding unit 120 in the image forming apparatus 100, the sheet conveyed from the multi-stage feeder 200 to the image forming apparatus 100 is fed to the image forming part 110 at a predetermined timing by the pre-registration roller pair 132 and the registration roller pair 133.

The image forming part 110 has a photosensitive drum 111, a charger 112, a laser scanner 113, a developing unit 114, a transfer charger 115, a separation charger 116, a cleaner 117, and other components. At the time of image formation, the photosensitive drum 111 is driven into rotation in a direction of the arrow in FIG. 1, and the surface of the photosensitive drum 111 is uniformly charged by the charger 112. Then, a laser light that the laser scanner 113 emits according to an image signal is reflected by a mirror 118 to be irradiated onto the charged photosensitive drum 111, whereby an electrostatic latent image is formed on the photosensitive drum 111. The electrostatic latent image thus formed on the photosensitive drum 111 is then visualized as a toner image by the developing unit 114.

Thereafter, the toner image on the photosensitive drum 111 is transferred onto the sheet S by the transfer charger 115 at a transfer part 115*a*. The sheet S onto which the toner image has been transferred is electrostatically separated from the photosensitive drum 111 by the separation charger 116. Toner remaining on the photosensitive drum 111 after the transfer is removed by the cleaner 117. The sheet S with the toner image transferred thereonto is conveyed by a conveying belt 119 to a fixing device 150, where the toner image is fixed. After that, the resultant sheet S is discharged from the apparatus by a discharge roller 151.

The following describes the multi-stage feeder 200 as the sheet feeding apparatus according to the present embodiment. First, with reference to FIGS. 2 to 4, the configuration of the multi-stage feeder 200 will be schematically described. The multi-stage feeder 200 has a plurality of storage cases 210 as sheet storage units each capable of storing a plurality of sheets. The plurality of storage cases 210 are arranged vertically in a plurality of stages. Each storage case 210 can be withdrawn from and inserted into an enclosure 204. The storage cases 210 have basically the same configuration except only for the number of sheets that can be stored. The number of sheets that can be stored may be the same among the storage cases 210.

A sheet fed from each storage case 210 is conveyed to the connection path 202 (FIG. 1) through a not-shown conveying path. Components of the multi-stage feeder 200 are each controlled by a control part 203 (FIG. 1). The control part 203 has a CPU (Central Processing Unit), a ROM (Read Only Memory), and a RAM (Random Access Memory). The control part 203 can communicate with the control part 140 of the image forming apparatus 100. By communicating with the control part 140, the control part 203 controls, for example, a sheet feeding timing.

Figure 3:
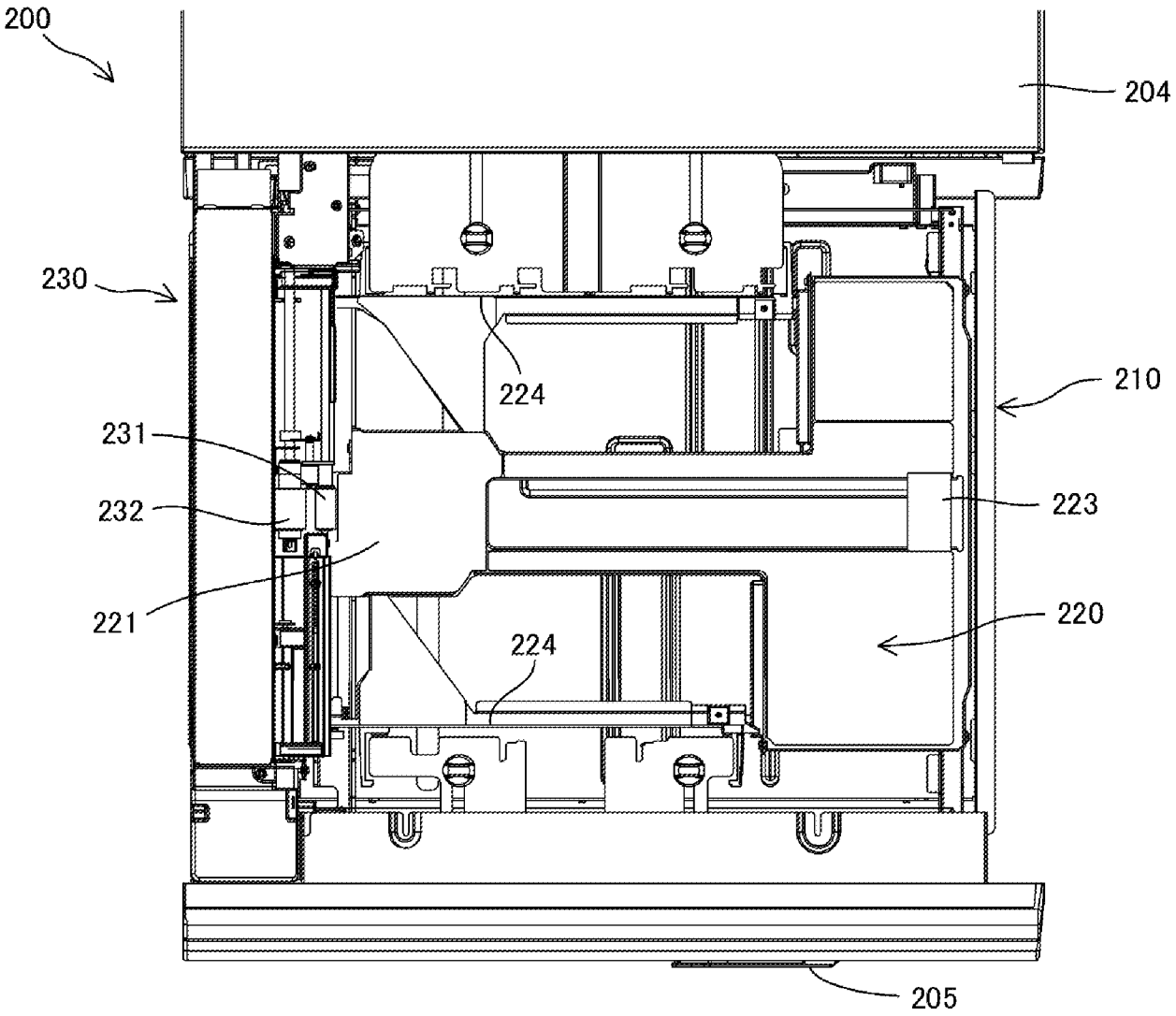
FIG. 3 is a top view of a storage case of the multi-stage feeder in a withdrawn state.

The multi-stage feeder 200 has a button 205 as an operation part for withdrawal of the storage case 210. The button 205 is provided on the front surface of each storage case 210. For example, when an operator presses the button 205, a locking mechanism that is locking the storage case 210 at an attachment position is released, and the storage case 210 is pushed out from the enclosure 204 by a not-shown spring. This allows the operator to withdraw the storage case 210 to a position allowing sheets to be stored therein, as illustrated in FIG. 3. Alternatively, the storage case 210 may be automatically moved to a position allowing sheets to be stored therein by means of a motor or the like in response to the press of the button 205.

Figure 4:
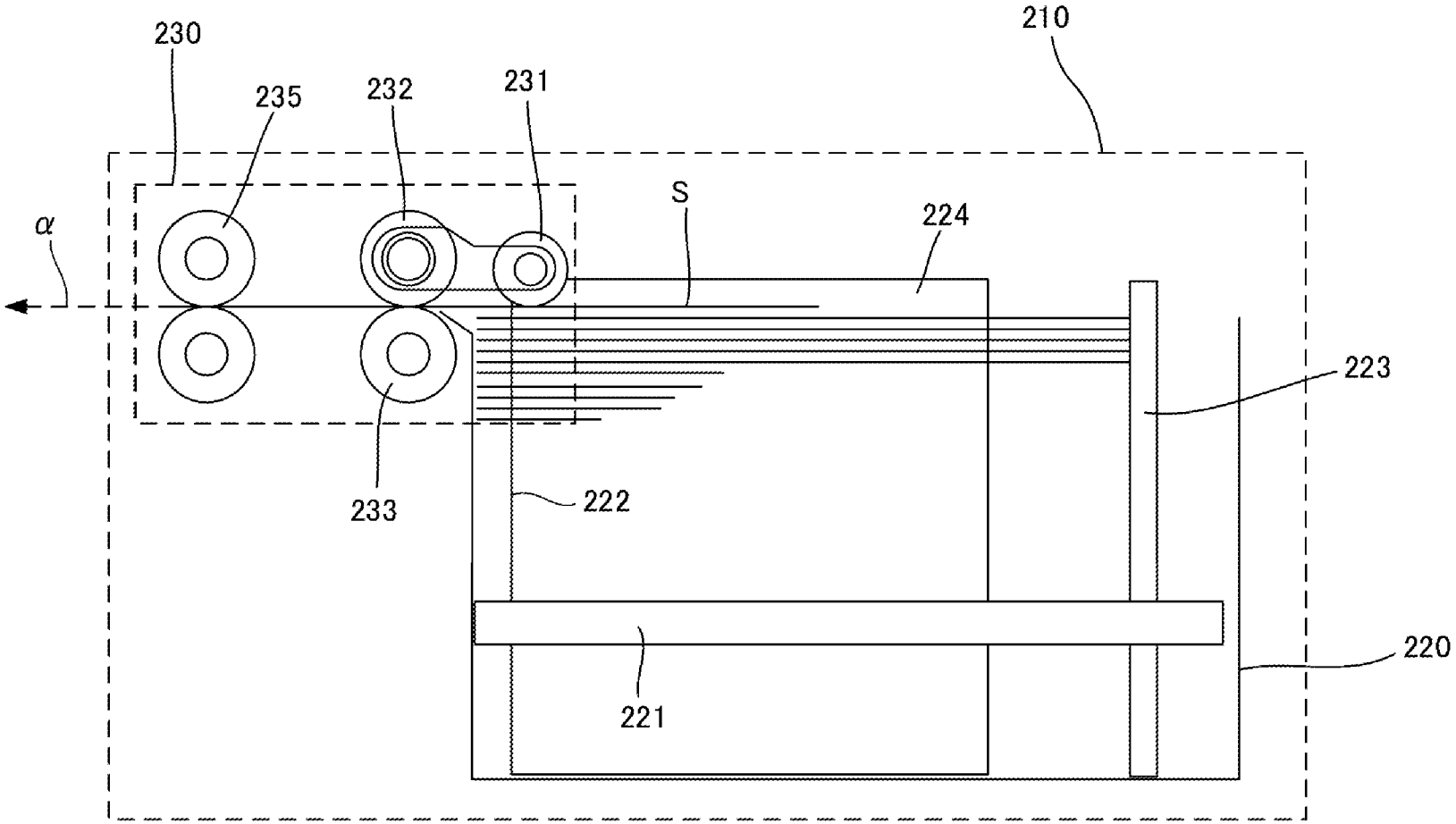
FIG. 4 is a schematic view of the storage case.

As illustrated in FIG. 4, the storage case 210 has a sheet storage part 220 capable of storing the sheets S and a feeding part 230 that feeds the sheets S from the sheet storage part 220 toward the image forming apparatus 100. The sheet storage part 220 has a stacking tray 221 on which the sheets S are stacked, a sheet abutting part 222, a rear end regulating plate 223, a side regulating plate 224, and other members. The stacking tray 221 is configured to be vertically movable by a not-shown elevating mechanism. The stacking tray 221 moves down to a predetermined position for stacking the sheets S and gradually moves up as the stacked sheets S are fed out.

The abutting part 222 is disposed downstream in the sheet conveying direction in a storage space where the sheets are stored and receives the abutment of downstream ends in the sheet conveying direction (front ends) of the sheets stacked on the stacking tray 221. The rear end regulating plate 223 is disposed upstream in the sheet conveying direction in the storage space and receives the abutment of upstream ends in the sheet conveying direction (rear ends) of the sheets stacked on the stacking tray 221 to regulate the rear end position of the sheets. The rear end regulating plate 223 is configured to be movable in the sheet conveying direction, allowing the rear end regulation position of the sheets to be adjusted in accordance with sheet size. The side regulating plate 224 is disposed on both sides of the storage space in the width direction perpendicular to the sheet conveying direction and regulates the both-end positions in the sheet width direction. The side regulating plate 224 is configured to be movable in the width direction, allowing the regulation position of the sheets in the width direction to be adjusted in accordance with sheet size.

As illustrated in FIG. 4, the feeding part 230 has a pickup roller 231 as a feeding roller, a separating and conveying roller pair 234 constituted of a conveying roller 232 and a retard roller 233, a conveying roller pair 235, and other members. The pickup roller 231 and separating and conveying roller pair 234 are disposed at the downstream end of the storage space in the sheet conveying direction and at substantially the center of the storage space in the width direction.

The pickup roller 231 is provided above the stacking tray 221 and abuts against and feeds the uppermost one of the sheets S stacked on the lifted stacking tray 221. To this end, as illustrated in FIG. 4, the pickup roller 231 is disposed so as to be brought into pressure contact with the uppermost one of the sheets S stacked on the stacking tray 221 at its portion in the vicinity of the front end in the sheet conveying direction (direction of arrow α) with an appropriate force. The pickup roller 231 then rotates to feed the uppermost sheet in the direction of arrow α.

The separating and conveying roller pair 234 is configured to separate one sheet from another, when two or more sheets are collectively fed from the pickup roller 231, and to convey only one sheet. Specifically, the conveying roller 232 of the separating and conveying roller pair 234 rotates in such a direction as to convey the sheet in the direction of arrow α and conveys the sheet fed from the pickup roller 231. The retard roller 233 rotates in a direction opposite to the rotation direction of the conveying roller 232 to push back some of the two or more sheets fed from the pickup roller 231 other than the uppermost sheet to the stacking tray 221. The retard roller 233 incorporates a not-shown torque limiter and is rotated by the sheet conveyed by the conveying roller 232 when only one sheet is properly fed to the separating and conveying roller pair 234.

The sheet that has passed through the separating and conveying roller pair 234 is then conveyed, by the conveying roller pair 235, to a not-shown conveyance path in the multi-stage feeder 200 and conveyed to the image forming apparatus 100 through the connection path 202 (FIG. 1) as described above.

In the present embodiment, the feeding part 230 is provided in the storage case 210 as described above. Thus, when the storage case 210 is withdrawn from and inserted into the enclosure 204 of the multi-stage feeder 200, the feeding part 230 is moved together with the storage case 210. The feeding part 230 can thus be withdrawn together with the storage case 210, thereby facilitating maintenance such as replacement of the rollers of the feeding part 230.

The following describes the configuration of the feeding part 230 in detail with reference to FIGS. 5 to 10. FIGS. 5 to 7 and FIG. 10 illustrate only a part of the feeding part 230 and omit the retard roller 233, conveying roller pair 235 and other members. FIGS. 8 and 9 illustrate the feeding part 230 as viewed from the right side of FIG. 5 with a part thereof omitted.

Figure 5:
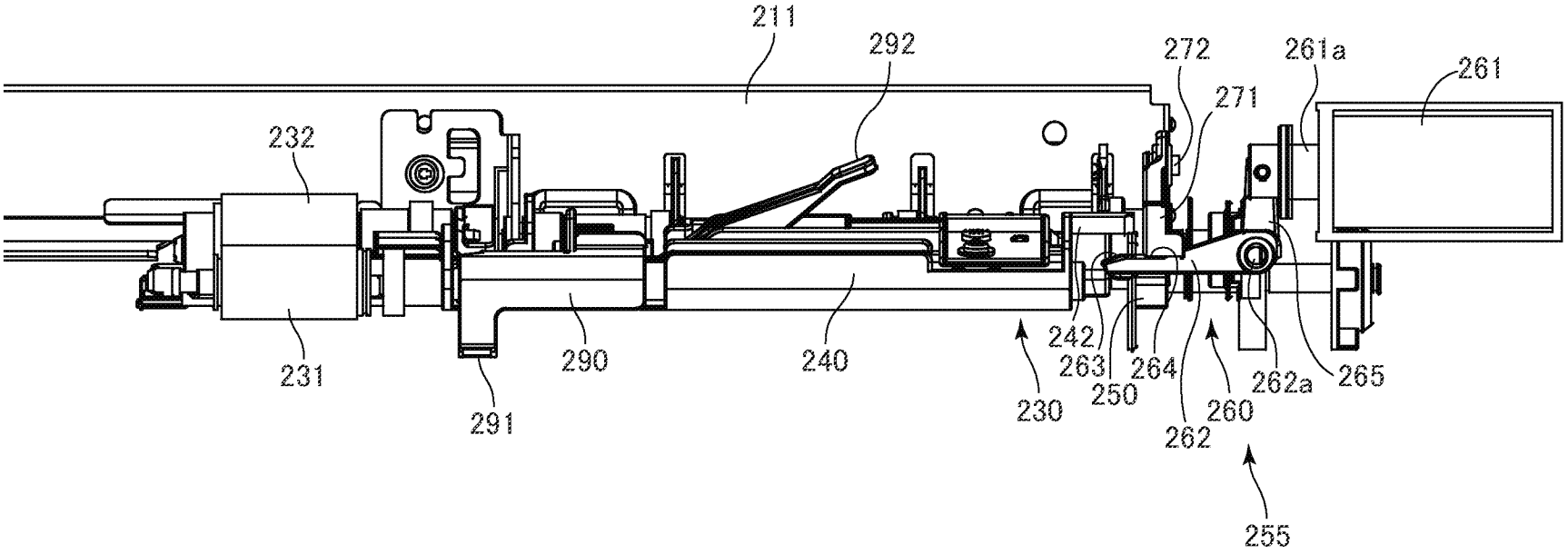
FIG. 5 is a front view illustrating a part of a feeding part.
Figure 6:
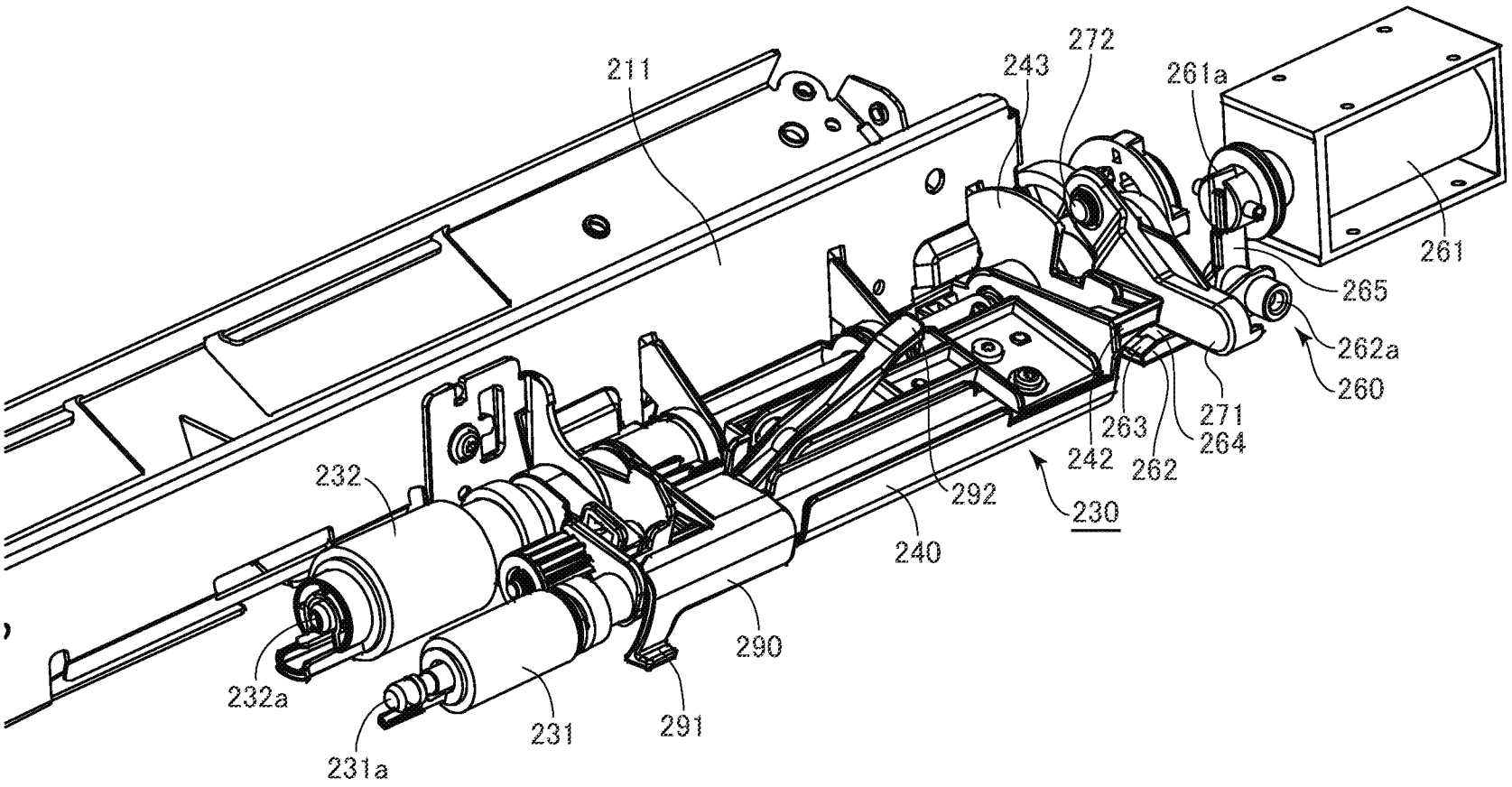
FIG. 6 is a perspective view illustrating a part of the feeding part.
Figure 7:
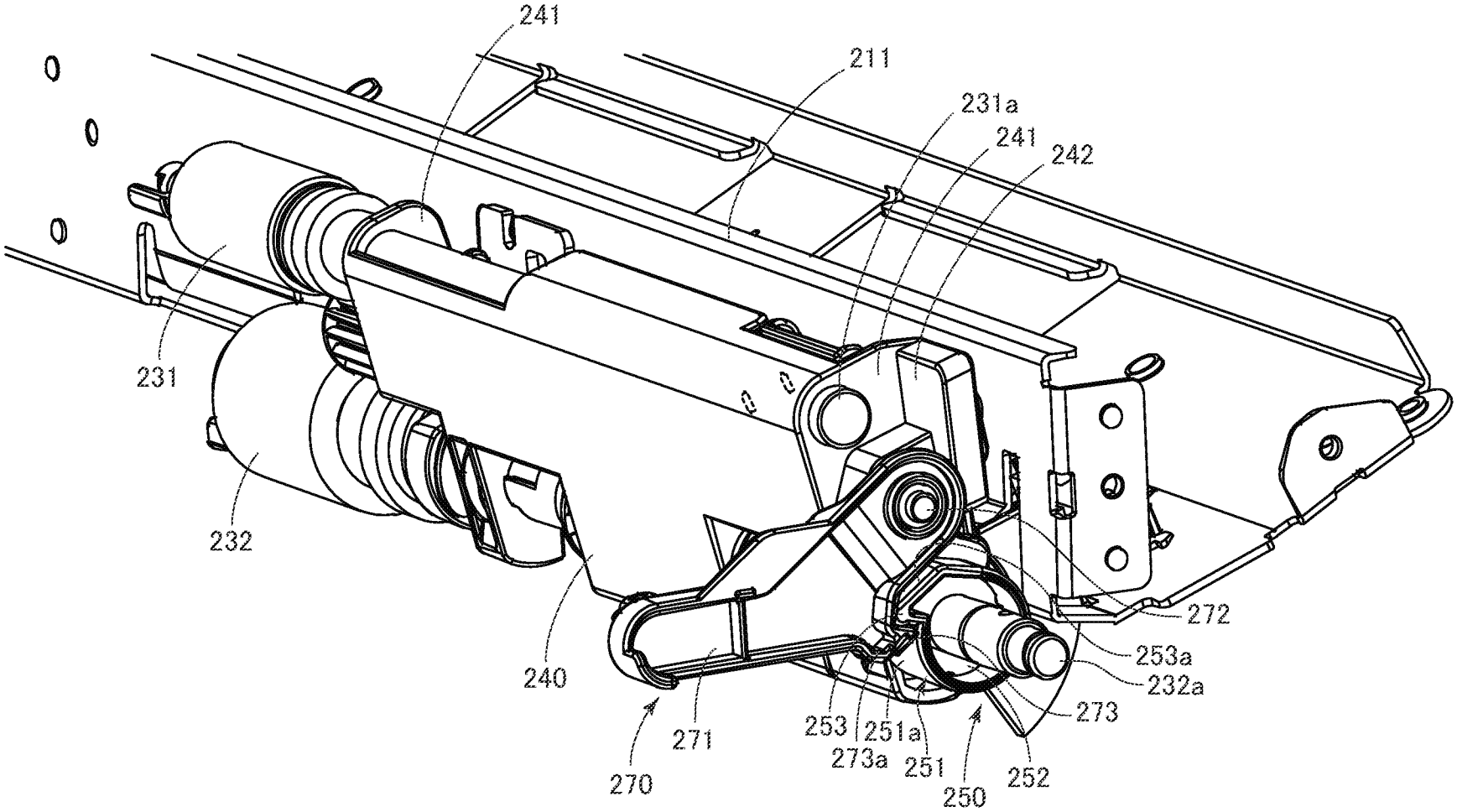
FIG. 7 is a perspective view illustrating a configuration to lock the feeding part at a first retracting position.

As illustrated in FIGS. 5 to 7, the feeding part 230 has a support plate 240 as a support means and a support member for supporting the pickup roller 231 and a separating and contacting mechanism 255 that moves the pickup roller 231 between a feeding position where the pickup roller 231 contacts the sheet to feed the same and a first retracting position where the pickup roller 231 is separated from the sheet. The separating and contacting mechanism 255 has a moving mechanism 250 for retracting the pickup roller 231 from the feeding position and a holding mechanism 260 for holding the pickup roller 231 at a second retracting position to be described later.

The support plate 240 is freely rotatably supported with respect to a rotary shaft 232*a* of the conveying roller 232 as a conveying roller rotary shaft. That is, the support plate 240 can swing about the rotary shaft 232*a* (swing shaft) of the conveying roller 232. The rotary shaft 232*a* of the conveying roller 232 extends substantially parallel to the rotation axis of the pickup roller 231, which is a rotary body. That is, the rotary shaft 232*a* of the conveying roller 232 and a rotary shaft 231*a* of the pickup roller 231 extend substantially parallel to each other. The rotary shaft 232*a* of the conveying roller 232 is freely rotatably supported by a frame 211 of the storage case 210.

As illustrated in FIG. 7, the rotary shaft 231*a* of the pickup roller 231 is freely rotatably supported by a rotary support part 241 of the support plate 240. Thus, when the support plate 240 swings about the rotary shaft 232*a* of the conveying roller 232, the pickup roller 231 also swings about the rotary shaft 232*a*. This vertically moves the pickup roller 231. That is, the pickup roller 231 moves up and down with respect to the sheets stacked on the stacking tray 221. Specifically, the pickup roller 231 can move up and down between the feeding position illustrated in FIGS. 8A, 8B and the first retracting position illustrated in FIGS. 9A and 9B. Details of the elevation operation will be described later.

As described above, at the feeding position, the pickup roller 231 abuts against and feeds the uppermost one of the sheets stacked on the stacking tray 221. At the first retracting position, the pickup roller 231 retracts from the storage space when the sheets are stored in the sheet storage part 220. That is, in the present embodiment, the feeding part 230 is provided in the storage case 210 and is withdrawn together with the storage case 210. At this time, if the pickup roller 231 is positioned at the feeding position, the pickup roller 231 and sheets are likely to interfere with each other when the sheets are stacked on the stacking tray 221, making it difficult to stack the sheets. Thus, in the present embodiment, when the storage case 210 is withdrawn, the pickup roller 231 is moved to the first retracting position which is a position less likely to hinder sheet stacking.

As illustrated in FIGS. 5 and 6, a detection sensor 290, which is capable of detecting the presence of any sheet stored in the sheet storage part 220 when the pickup roller 231 is located at the feeding position, is freely swingably supported by the support plate 240. The detection sensor 290 has a contact part 291 capable of contacting the uppermost one of the sheets stacked on the stacking tray 221. When the contact part 291 contacts the sheet, the detection sensor 290 detects the presence of the sheet, and the pickup roller 231 sends out the sheet.

The thus configured detection sensor 290 is configured to retract from a position where it can detect the sheet when the pickup roller 231 supported by the support plate 240 moves to the first retracting position. That is, when the pickup roller 231 supported by the support plate 240 is located at the feeding position, the detection sensor 290 is located at a first position where the contact part 291 protrudes to the sheet side from the pickup roller 231 in a state where the sheets stored in the sheet storage part 220 is not contacting the pickup roller 231. On the other hand, when the pickup roller 231 supported by the support plate 240 is located at the first retracting position, the detection sensor 290 is located at a second position where the contact part 291 is not protruding from the pickup roller 231 with respect to the first position.

To realize the above configuration, a retracting lever 292 is freely swingably supported by the support plate 240. The retracting lever 292 is disposed such that one end portion thereof in the longitudinal direction is positioned below the detection sensor 290 with respect to the swing axis, and the other end portion thereof in the longitudinal direction protrudes upward at the feeding position. When the pickup roller 231 supported by the support plate 240 moves to the first retracting position, the other end portion of the retracting lever 292 abuts against the frame 211 to swing about the swing axis, with the result that the one end portion of the retracting lever 292 lifts the detection sensor 290. Thus, the detection sensor 290 swings to locate the contact part 291 at the second position.

Further, a support plate side engagement part 242 is integrally formed at the end portion of the support plate 240. The support plate side engagement part 242 is formed so as to protrude from the rotary support part 241 on one side in the direction of the rotary axis of the rotary shaft 232*a* and can be engaged with a retracting engagement part 254 (FIG. 8A, etc.) to be described later of the moving mechanism 250.

As illustrated in FIGS. 7, 8A, 8B, 9A, and 9B, the moving mechanism 250 has an engagement member 251 which is disposed around the rotary shaft 232*a* of the conveying roller 232 and outside the support plate 240 and a one-way clutch 252 which is disposed between the engagement member 251 and the rotary shaft 232*a*. The engagement member 251 is constituted of a support part 251*a*, a locking engagement part 253, and a retracting engagement part 254.

The support part 251*a* is formed into a substantially cylindrical shape and is supported, through the one-way clutch 252, with respect to the rotary shaft 232*a* as the conveying roller rotary shaft. The one-way clutch 252 transmits the drive of the rotary shaft 232*a* to the support part 251*a* when the rotary shaft 232*a* of the conveying roller 232 rotates in a direction (clockwise direction in FIGS. 8A and 9A) opposite to the direction in which the conveying roller 232 feeds the sheets. At this time, a motor 301 (FIGS. 11 and 14) to be described later for driving the conveying roller 232 into rotation reversely rotates.

The one-way clutch 252 rotates idly when the rotary shaft 232*a* of the conveying roller 232 rotates in a direction (counterclockwise direction in FIGS. 8A and 9A) the same as the direction in which the conveying roller 232 feeds the sheets, so that the drive of the rotary shaft 232*a* is not transmitted to the support part 251*a*. At this time, a motor 301 (FIGS. 11 and 14) to be described later for driving the conveying roller 232 into rotation normally rotates.

The locking engagement part 253 is formed so as to protrude from the outer peripheral surface of the support part 251*a*. As illustrated in FIG. 7, the locking engagement part 253 constitutes a locking mechanism 270 capable of locking the pickup roller 231 supported by the support plate 240 at the first retracting position.

Figure 9A:
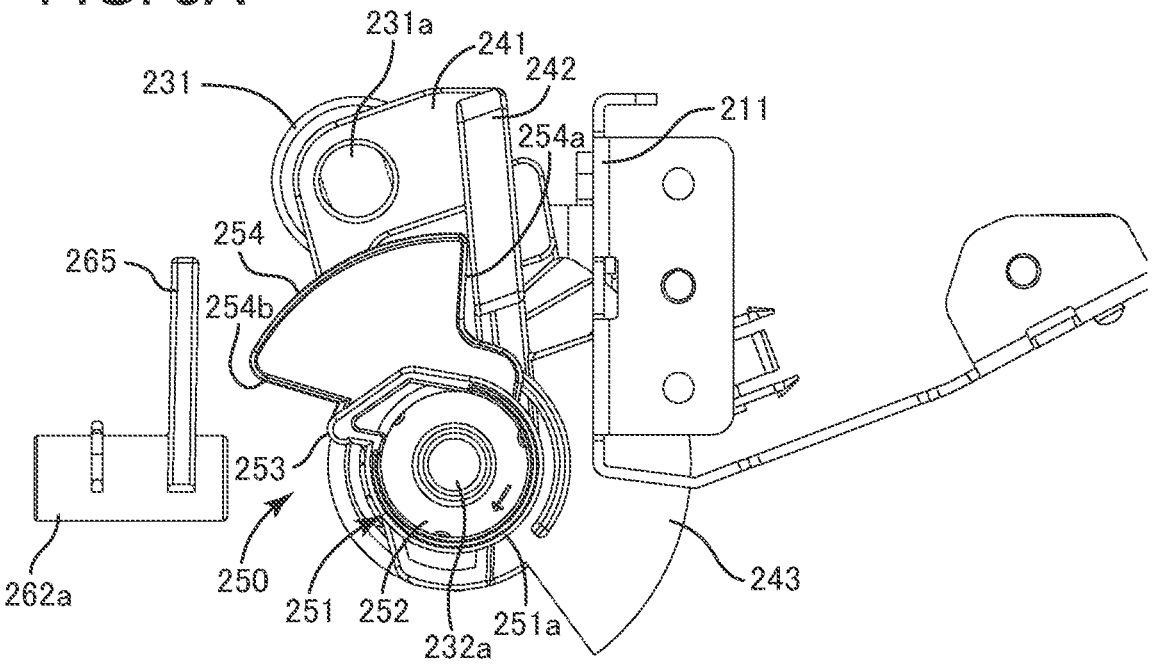
FIGS. 9A and 9B are a side view and a perspective view, respectively, each illustrating the first retracting position of the feeding part.
Figure 9B:
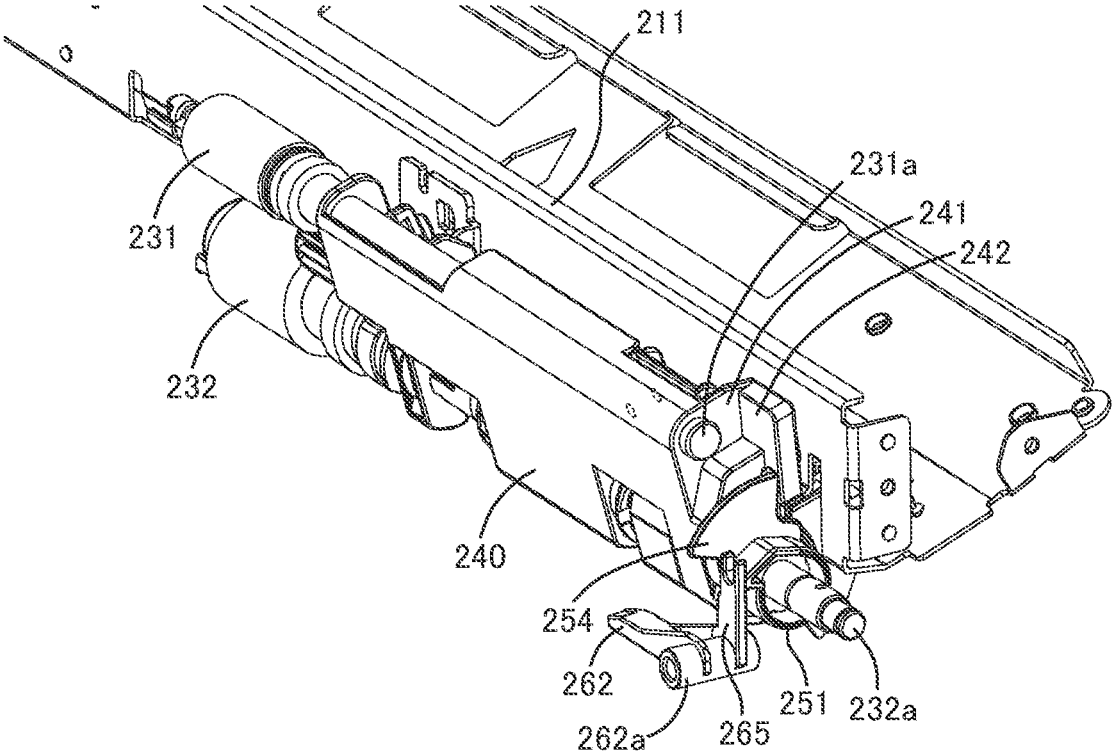

As illustrated in FIG. 9B, the retracting engagement part 254 is formed into a substantially fan-like shape and is formed integrally with the support part 251*a* at the support plate 240 side of the support part 251*a* in the rotary axis direction of the rotary shaft 232*a*. The retracting engagement part 254 can be engaged with the support plate side engagement part 242 constituting a part of the support plate 240 described above.

Figure 8A:
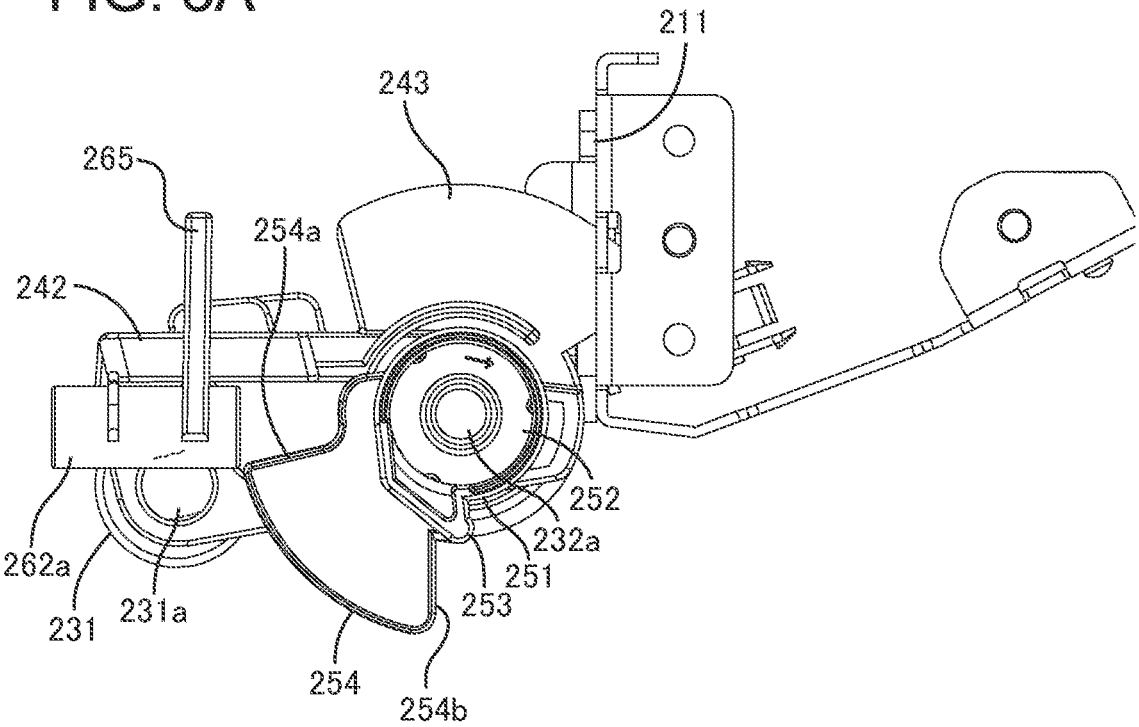
FIGS. 8A and 8B are a side view and a perspective view, respectively, each illustrating a feeding position of the feeding part.

To move the pickup roller 231 supported by the support plate 240 from the feeding position to the first retracting position, the motor 301 is reversely rotated to rotate the engagement member 251 in the clockwise direction as indicated in FIGS. 8A and 9A through the rotary shaft 232*a*. Then, a retracting side engagement surface 254*a* of the retracting engagement part 254 of the engagement member 251 is engaged with the support plate side engagement part 242. Then, when the engagement member 251 further rotates, the support plate 240 and the pickup roller 231 move to the first retracting position as illustrated in FIGS. 9A and 9B. The completion of the movement of the pickup roller 231 to the first retracting position can be grasped as follows. That is, when the pickup roller 231 is moved to the first retracting position, a flag 243 (FIG. 6) provided on the support plate 240 is exposed by passing through a slit formed in the frame 211, and a not-shown sensor provided on the back of the frame 211 detects the flag 243.

The locking mechanism 270 has a swing lever 271 and the locking engagement part 253 of the engagement member 251. The swing lever 271 is vertically swingable about a swing shaft 272 supported by the frame (not illustrated in FIGS. 5 to 7) of the storage case 210. The swing lever 271 has a lever side engagement part 273 that can be engaged with the locking engagement part 253. The locking engagement part 253 of the engagement member 251 that has thus moved the pickup roller 231 to the first retracting position is engaged with the lever side engagement part 273 of the swing lever 271, whereby the pickup roller 231 is locked at the first retracting position.

The outer peripheral surface of the locking engagement part 253 of the engagement member 251 on the downstream side in the clockwise direction is formed as a slope 253*a* that is inclined in a direction away from the rotary shaft 232*a* as it goes from the downstream side to the upstream side. Further, as a counterpart member of the slope 253*a*, an engagement surface 273*a* is formed below the lever side engagement part 273 of the swing lever 271. The engagement surface 273*a* is engaged with the slope 253*a* when the engagement member 251 rotates to move the pickup roller 231 supported by the support plate 240 from the feeding position to the first retracting position to thereby swing the swing lever 271 upward about the swing shaft 272. When the slope 253*a* rides over the engagement surface 273*a*, the swing lever 271 swings downward to allow engagement of the lever side engagement part 273 with the locking engagement part 253.

As illustrated in FIGS. 5 and 6, the holding mechanism 260 has a solenoid 261 and a holding lever 262 as a holding member driven by the solenoid 261. When the solenoid 261 is turned ON by energization, a plunger 261*a* retracts; when it is turned OFF (not energized), the plunger 261*a* protrudes. The holding lever 262 can vertically swing about a swing shaft 262*a* extending in a direction perpendicular to the advancing and retracting direction of the plunger 261*a*. Further, a first engagement part 263 that can be engaged with the support plate side engagement part 242 of the support plate 240 is provided on the upper surface of the leading end portion of the holding lever 262, and a second engagement part 264 that can be engaged with the lower surface of the swing lever 271 is provided on a part of the upper surface of the holding lever 262 that is positioned between the first engagement part 263 and the swing shaft 262*a*.

A link mechanism 265 is provided between the plunger 261*a* of the solenoid 261 and the holding lever 262. When the solenoid 261 is turned ON, the plunger 261*a* retracts to cause the holding lever 262 to swing upward about the swing shaft 262*a*; when the solenoid 261 is turned OFF, the plunger 261*a* protrudes to cause the holding lever 262 to swing downward about the swing shaft 262*a*.

As will be described in detail later, by turning ON and OFF the solenoid 261, the thus configured holding mechanism 260 can switch between a holding position where the pickup roller 231 supported by the support plate 240 can be held at a second retracting position and a holding release position where the hold of the support plate 240 supporting the pickup roller 231 can be released. The holding position is a position where the holding lever 262 has been moved upward by turning ON the solenoid 261, and the holding release position is a position where the holding lever 262 has been moved downward by turning OFF the solenoid 261.

Figure 10A:
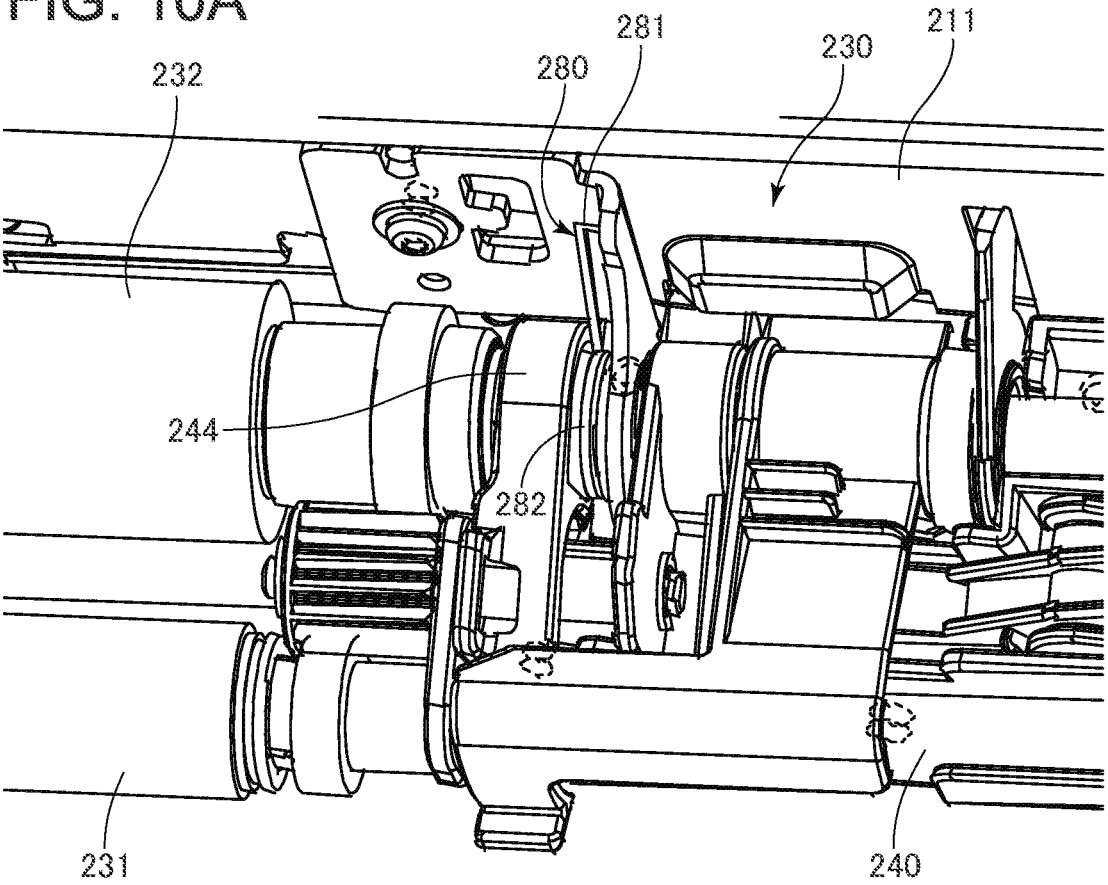
FIG. 10A is a perspective view illustrating a biasing spring for a pickup roller assembled to the storage case.
Figure 10B:
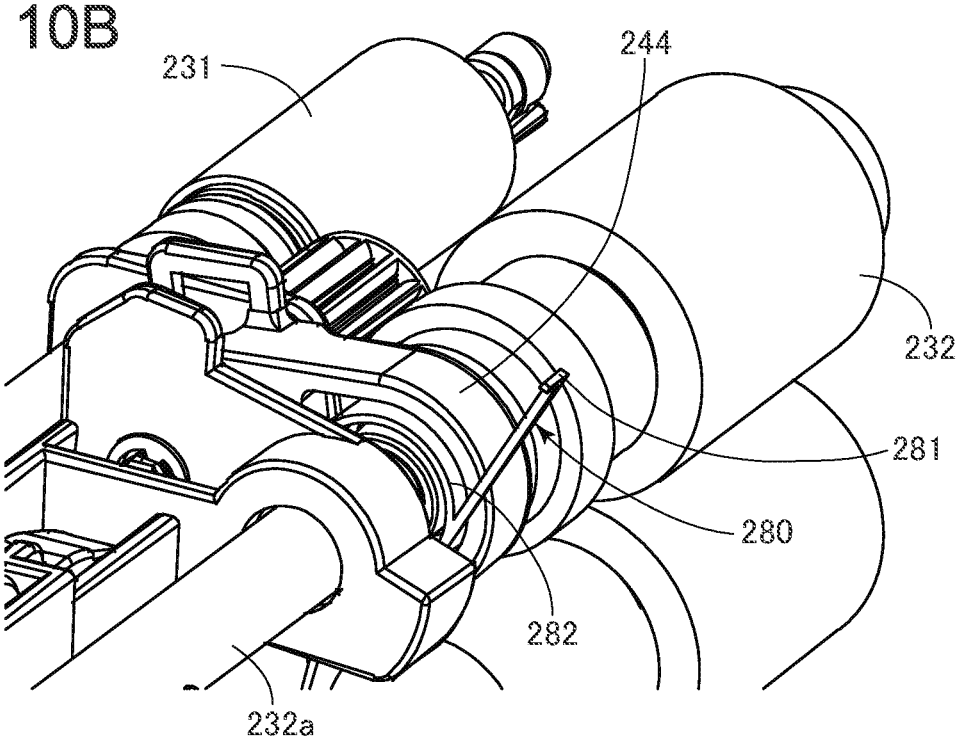
FIG. 10B is a perspective view illustrating a state where the biasing spring is taken out from the storage case.

Further, as illustrated in FIGS. 10A and 10B, the feeding part 230 has a biasing spring 280 as a biasing member for biasing the pickup roller 231 supported by the support plate 240 toward the feeding position from the first retracting position. The biasing spring 280 is a coil spring and has a hook part 281 and a coil part 282. The hook part 281 is hooked on a part of the frame 211, and the coil part 282 is disposed between the periphery of the rotary shaft 232*a* of the conveying roller 232 and a spring receiving part 244 integrally formed with the support plate 240. With this configuration, the biasing spring 280 biases, through the spring receiving part 244, the support plate 240 downward about the rotary shaft 232*a*, i.e., in a direction that the pickup roller 231 moves to the feeding position.

As described above, the engagement member 251 that moves the pickup roller 231 supported by the support plate 240 toward the first retracting position receives a drive from the rotary shaft 232*a* when the rotary shaft 232*a* is rotated in a direction opposite to the sheet conveying direction of the conveying roller 232 by the one-way clutch 252. On the other hand, when the rotary shaft 232*a* rotates in a direction opposite to the above, no drive is transmitted from the rotary shaft 232*a* to the engagement member 251. In this case, the one-way clutch 252 rotates idly, and the pickup roller 231 supported by the support plate 240 swings in a direction from the first retracting position toward the feeding position by its own weight and the biasing force of the above biasing spring 280. Accordingly, the engagement member 251 is driven by the reverse rotation of the motor 301 to move the pickup roller 231 supported by the support plate 240 from the feeding position to the first retracting position; conversely, the engagement member 251 driven by the normal rotation of the motor 301 moves the pickup roller 231 from the first retracting position to the feeding position.

Figure 11:
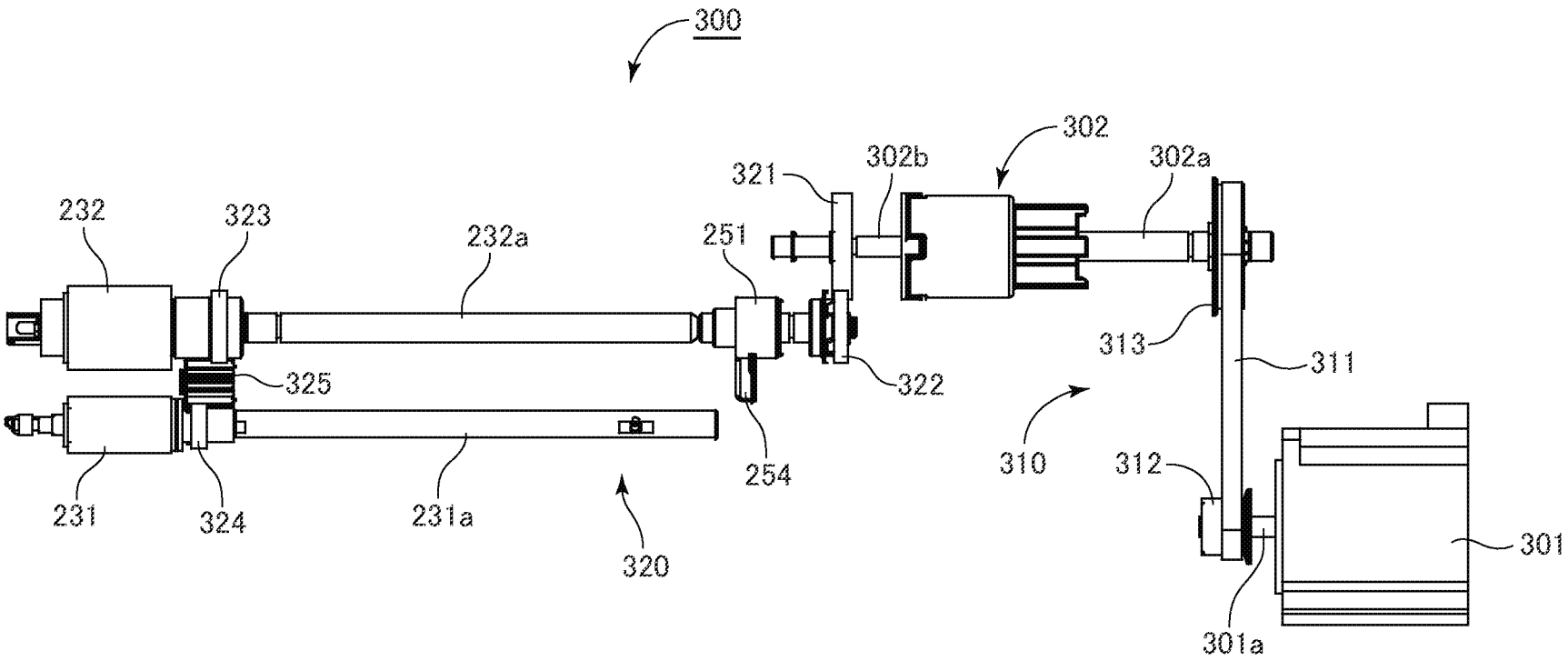
FIG. 11 is a plan view illustrating a drive path from a drive motor to the pickup roller.
Figure 12:
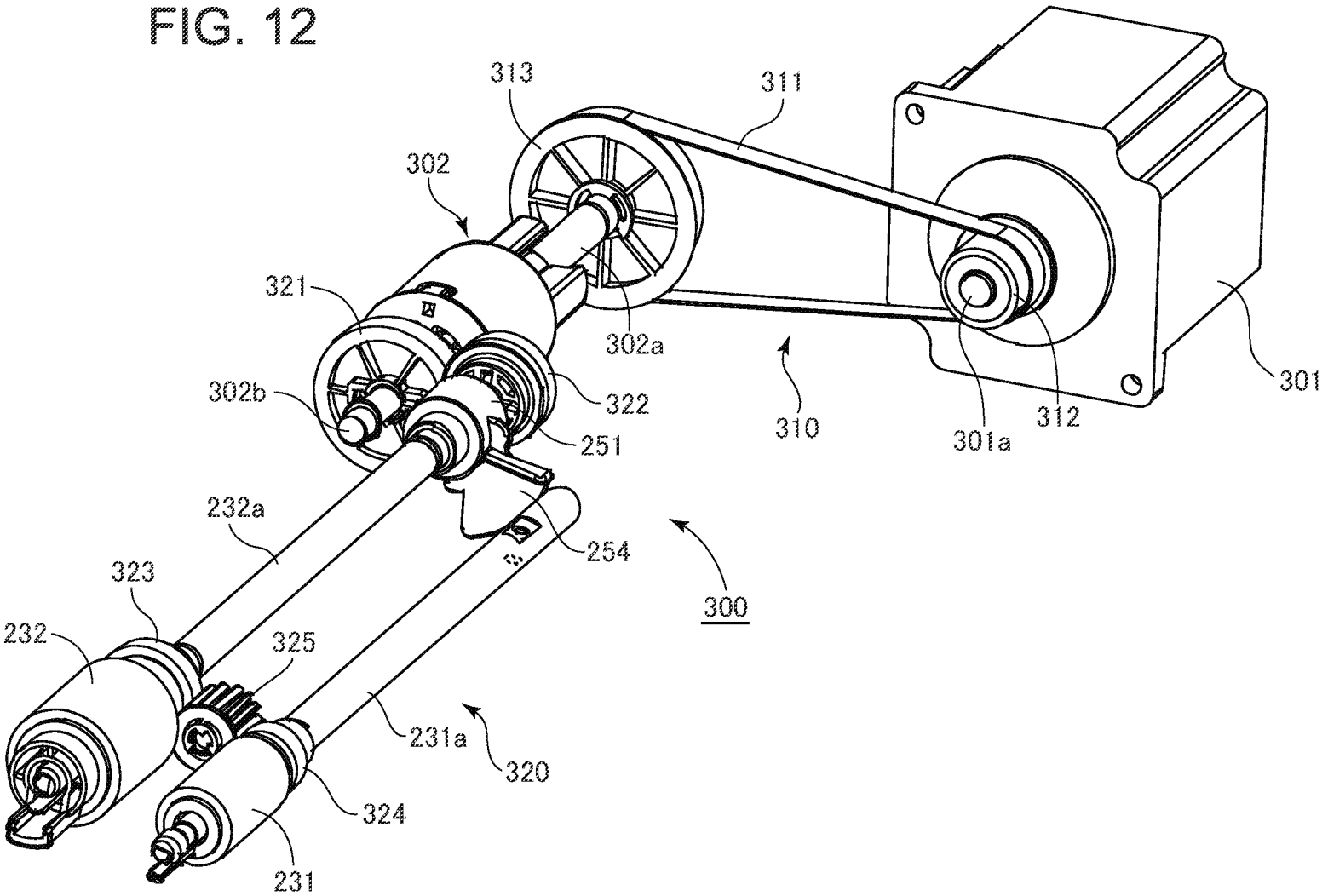
FIG. 12 is a perspective view illustrating the drive path from the drive motor to the pickup roller.

The following describes a drive transmission mechanism 300 of the conveying roller 232 and pickup roller 231 with reference to FIGS. 11 and 12. FIGS. 11 and 12 illustrate only a drive transmission path from the motor 301 to the pickup roller 231.

The motor 301 as a drive motor is, for example, a pulse motor and is provided in the enclosure 204 of the multi-stage feeder 200. Thus, the drive transmission mechanism 300 has a coupling 302 as a connection part for dividing in the middle the drive transmission path from the motor 301 to the conveying roller 232 when the storage case 210 is withdrawn from the enclosure 204. Specifically, the drive transmission mechanism 300 has a motor-side drive transmission mechanism 310 ranging from the motor 301 to the coupling 302 and a roller-side drive transmission mechanism 320 ranging from the coupling 302 to the pickup roller 231. The coupling 302 connects the motor 301 and the pickup roller 231 so as to allow a drive to be transmitted therebetween in a state where the storage case 210 is inserted into the enclosure 204 and releases the drive connection between the motor 301 and the pickup roller 231 when the storage case 210 is withdrawn.

The motor-side drive transmission mechanism 310 transmits a drive from a drive shaft 301*a* of the motor 301 to a transmission shaft 302*a* for drive transmission to the coupling 302 by means of a belt 311 and pulleys 312, 313. Specifically, the pulleys 312 and 313 are mounted to the drive shaft 301*a* and the transmission shaft 302*a*, respectively, and the belt 311 having an endless shape is wound over the pulleys 312 and 313. Thus, the drive of the motor 301 is transmitted to the transmission shaft 302*a* through the pulley 312, belt 311, and pulley 313. The motor-side drive transmission mechanism 310 is not limited to the mechanism that transmits a drive by means of the pulley and belt, but may be a mechanism that transmits a drive by means of a gear train.

The roller-side drive transmission mechanism 320 transmits a drive from another transmission shaft (302*b*) of the coupling 302 to pickup roller 231. The roller-side drive transmission mechanism 320 has a gear 321 mounted to the transmission shaft 302*b*, a gear 322 mounted to the end portion of the rotary shaft 232*a* of the conveying roller 232, a gear 323 mounted to the intermediate portion of the rotary shaft 232*a*, a gear 324 mounted to the rotary shaft 231*a* (feeding roller rotary shaft) of the pickup roller 231, and an idle gear 325 mounted between the gears 323 and 324. In the present embodiment, the rotary shaft 231*a* of the pickup roller 231 receives the drive of the motor 301 through the rotary shaft 232*a* of the conveying roller 232 and the idle gear 325.

A drive is transmitted from the transmission shaft 302*b* to the pickup roller 231 as follows. First, the drive of the motor 301 is transmitted to the transmission shaft 302*b* through the motor-side drive transmission mechanism 310 and the coupling 302. Then, the rotation of the transmission shaft 302*b* is transmitted to the gear 322 engaged with the gear 321 to rotate the rotary shaft 232*a*, thereby rotating the conveying roller 232. Then, the rotation of the rotary shaft 232*a* is sequentially transmitted to the idle gear 325 engaged with the gear 323 and the gear 324 engaged with the idle gear 325 to rotate the rotary shaft 231*a*, thereby rotating the pickup roller 231. The idle gear 325 is provided for rotating the conveying roller 232 and the pickup roller 231 in the same direction. A configuration may be adopted in which the rotary shaft 231*a* is fixed so as not to rotate, the pickup roller 231 and gear 324 are freely rotatably supported by the rotary shaft 231*a*, and the gear 324 and the pickup roller 231 are coupled to each other. In this case, when a drive is transmitted from the idle gear 325 to the gear 324, the pickup roller 231 rotates together with the gear 324 relative to the rotary shaft 231*a*.

The motor 301 can rotate both normally and reversely. When the motor 301 normally rotates, the conveying roller 232 and pickup roller 231 rotate in a direction to convey the sheet; on the other hand, when the motor 301 rotates reversely, the conveying roller 232 and pickup roller 231 rotate in a direction opposite to the sheet conveying direction. Further, the reverse rotation of the motor 301 transmits rotation from the rotary shaft 232*a* to the engagement member 251 (FIG. 8A, etc.) through the one-way clutch 252, with the result that the pickup roller 231 and the support plate 240 move from the feeding position to the first retracting position.

The motor 301 and the motor-side drive transmission mechanism 310 are provided in the enclosure 204, while the pickup roller 231, conveying roller 232, and roller-side drive transmission mechanism 320 are provided in the storage case 210. When the storage case 210 is withdrawn from the enclosure 204, the coupling 302 is divided to prevent the drive of the motor 301 from being transmitted to the conveying roller 232 side. On the other hand, when the storage case 210 is inserted into the enclosure 204 to be attached to a predetermined attachment position of the enclosure 204, the divided parts of the coupling 302 are coupled, allowing the drive of the motor 301 to be transmitted to the conveying roller 232 side. The predetermined attachment position refers to a position allowing the sheets stored in the storage case 210 to be conveyed in the multi-stage feeder 200.

The following describes the operation of the feeding part 230 when the storage case 210 is withdrawn from the enclosure 204. To withdraw the storage case 210 from the enclosure 204 so as to store sheets, an operator operates the button 205 as described above. Then, the control part 203 for controlling the motor 301 reversely rotates the motor 301 before withdrawal of the storage case 210 to locate the pickup roller 231 supported by the support plate 240 at the first retracting position.

That is, in a state where the storage case 210 is at a predetermined attachment position, the pickup roller 231 supported by the support plate 240 is located at the feeding position (FIGS. 8A and 8B, etc.) and can transmit the drive of the motor 301 to the conveying roller 232 side. Thus, the control part 203 reversely rotates the motor 301 in this state to transmit the drive to the roller-side drive transmission mechanism 320 through the motor-side drive transmission mechanism 310 and coupling 302.

Then, the rotary shaft 232*a* of the conveying roller 232 rotates, and this rotation is transmitted to the engagement member 251 through the one-way clutch 252 (FIGS. 9A and 9B, etc.). As described above, the one-way clutch 252 transmits the drive of the reverse rotation of the motor 301 to the engagement member 251. Thus, when the motor 301 is reversely rotated, the engagement member 251 receives the drive of the reverse rotation through the rotary shaft 232*a* and one-way clutch 252 to rotate in the clockwise direction in FIG. 8A, and the retracting engagement part 254 also rotates in the same direction together with the engagement member 251. Then, as described above, the retracting side engagement surface 254*a* of the retracting engagement part 254 is engaged with the support plate side engagement part 242. When the engagement member 251 further rotates, the support plate 240 and pickup roller 231 move to the first retracting position as illustrated in FIGS. 9A and 9B.

At this time, the locking engagement part 253 constituting the engagement member 251 also rotates in the same direction, which, as described above, causes the slope 253*a* to be engaged with the engagement surface 273*a* of the swing lever 271 to lift the swing lever 271. Then, when the slope 253*a* rides over the engagement surface 273*a*, the swing lever 271 swings downward to allow engagement of the lever side engagement part 273 with the locking engagement part 253, as illustrated in FIG. 7. As a result, the engagement member 251 is locked at this position, preventing the engagement member 251 from unintentionally rotating in a direction moving the pickup roller 231 supported by the support plate 240 to the feeding position even when the drive transmission from the motor 301 is interrupted. Further, when the engagement member 251 is thus locked, the pickup roller 231 supported by the support plate 240 being located at the first retracting position by the engagement with the retracting engagement part 254 is also locked at the first retracting position.

When the pickup roller 231 is thus locked at the first retracting position as described above, the control part 203 releases the locking mechanism that is locking the storage case 210 at a predetermined attachment position. When the pickup roller 231 is moved to the first retracting position, the flag 243 (see FIG. 9A) provided to the support plate 240 is exposed by passing through a slit formed in the frame 211, and a not-shown sensor provided on the back of the frame 211 detects the flag 243. Based on the detection of the flag 243 by the sensor, the control part 203 determines that the pickup roller 231 is in a locked state at the first retracting position.

When the control part 203 releases the above locking mechanism, the storage case 210 is pushed out from the enclosure 204 by a not-shown spring, allowing the storage case 210 to be withdrawn to a position allowing sheets to be stored therein. In the present embodiment, when the storage case 210 is thus withdrawn, the support plate 240 and pickup roller 231 are made to retract to the first retracting position and locked at this position. Thus, when an operator stores sheets in the sheet storage part 220, the pickup roller 231 does not become an obstacle, allowing the operator to easily store sheets in the sheet storage part 220.

The following describes the operation of the feeding part 230 when the storage case 210 is inserted into a predetermined attachment position in the enclosure 204 with reference to FIGS. 8, 9, 13 to 19. An operator stores sheets in the withdrawn storage case 210 and then inserts the storage case 210 into the enclosure 204. At this time, when, for example, a sheet loading amount is large, the uppermost sheet may contact the pickup roller 231 located at the feeding position. As described above, to move the pickup roller 231 from the first retracting position to the feeding position, the motor 301 is rotated (normally rotated) in a direction that the pickup roller 231 feeds the sheet.

Thus, if the pickup roller 231 is moved without being stopped from the first retracting position to the feeding position after attachment of the storage case 210 to a predetermined attachment position in the enclosure 204, the uppermost sheet may be conveyed by the pickup roller 231 since the pickup roller 231 is rotating during the conveyance. That is, the pickup roller 231 moves to the feeding position while rotating, causing the sheet to be conveyed at the same time the pickup roller 231 contacts the sheet.

In this state, the pickup roller 231 contacts the sheet with an insufficient pressure. For example, pressure distribution in the rotary axis direction of the roller is nonuniform. Thus, if the sheet is conveyed with such an unstable contact pressure, the position of sheet may be displaced to easily cause a failure such as sheet jamming or skewed conveyance. To cope with this, in the present embodiment, the feeding part 230 operates as follows.

Figure 13:
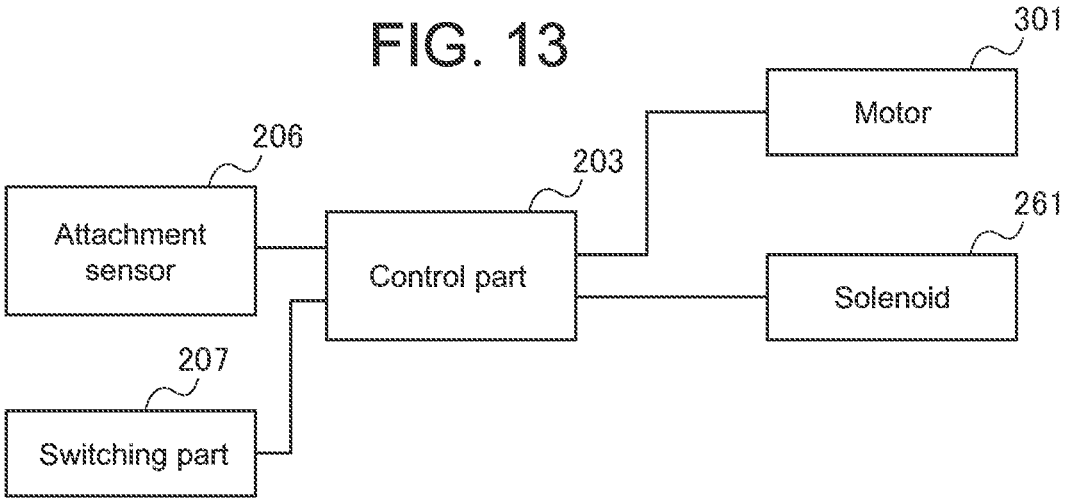
FIG. 13 is a block diagram illustrating a part of the control configuration of the multi-stage feeder.

As illustrated in FIG. 13, the control part 203 of the multi-stage feeder 200 controls the motor 301 and the solenoid 261. An attachment sensor 206 detects attachment of the storage case 210 to a predetermined attachment position in the enclosure 204. FIG. 13 illustrates only a part of the control configuration of the multi-stage feeder 200.

Figure 15:
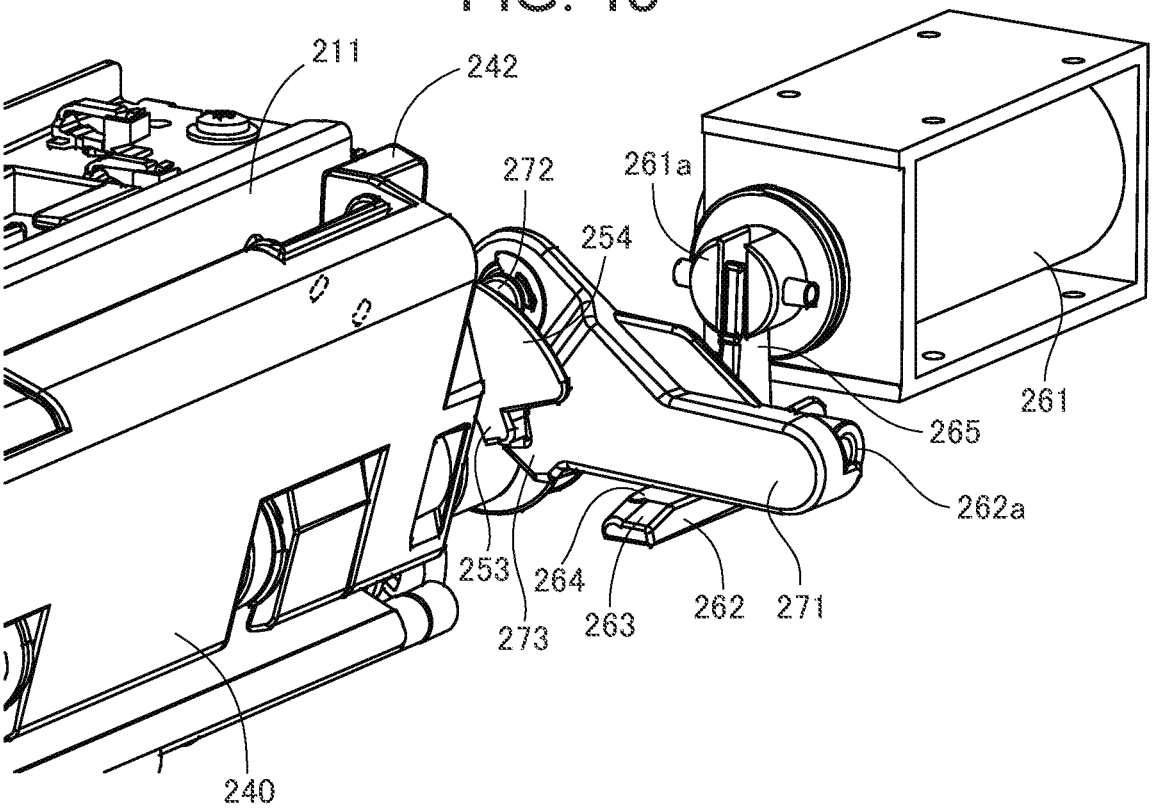
FIG. 15 is a perspective view illustrating a state where the feeding part is locked at the first retracting position.

In a state where sheets are stored in the storage case 210, the support plate 240 and the pickup roller 231 are located at the first retracting position as illustrated in FIGS. 9A and 9B. At this time, as illustrated in FIG. 15, the lever side engagement part 273 of the swing lever 271 of the locking mechanism 270 is engaged with the locking engagement part 253 of the engagement member 251, whereby the pickup roller 231 supported by the support plate 240 is locked at the first retracting position.

Figure 14:
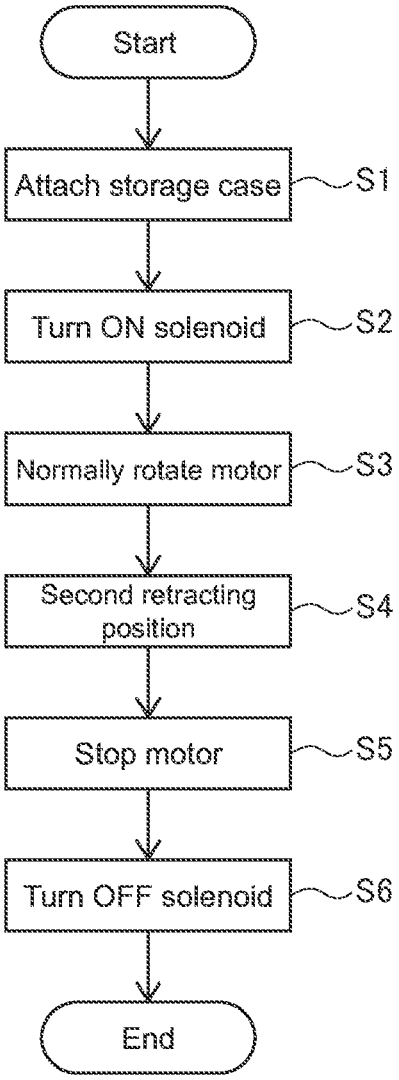
FIG. 14 is a flowchart illustrating a control procedure of moving the pickup roller from the first retracting position to the feeding position.

In this state, when the storage case 210 is attached to a predetermined attachment position in the enclosure 204, the control part 203 controls the motor 301 and solenoid 261 as follows. FIG. 14 illustrates the flow of this control. As described above, when the storage case 210 is attached to a predetermined attachment position in the enclosure 204, the coupling 302 is brought into a coupling state, allowing drive transmission from the motor 301 to the pickup roller 231 (see FIGS. 11 and 14).

Figure 16:
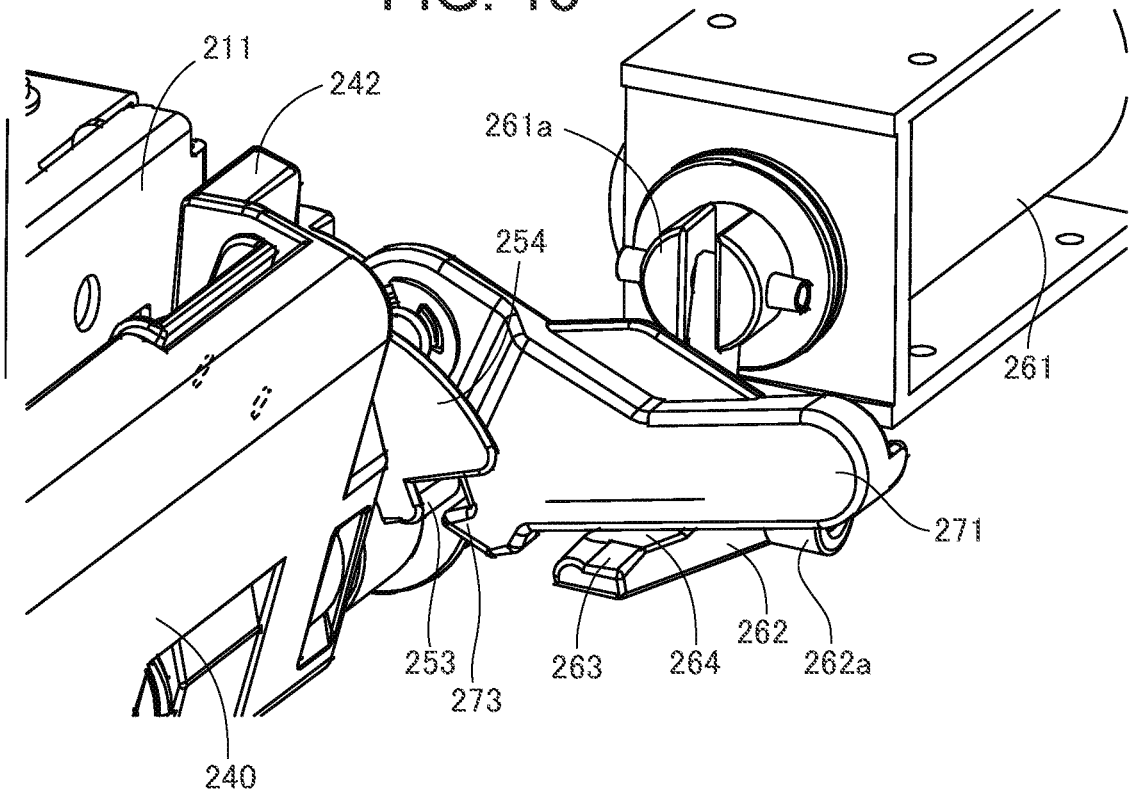
FIG. 16 is a perspective view illustrating a state where the lock of the feeding part is released.

When the attachment sensor 206 detects attachment of the storage case 210 to a predetermined attachment position in the enclosure 204 (S1), the control part 203 turns ON the solenoid 261 (S2). Then, as illustrated in FIG. 16, the plunger 261*a* retracts to cause the holding lever 262 to swing upward about the swing shaft 262*a*. At this time, the second engagement part 264 of the swing lever 271 is engaged with the lower surface of the swing lever 271 to lift the swing lever 271. That is, the holding mechanism 260 is located at the holding position. As a result, the engagement between the lever side engagement part 273 of the swing lever 271 and the locking engagement part 253 of the engagement member 251 is released to release the lock of the engagement member 251. That is, the locking mechanism 270 releases the lock of the support plate 240 through the switching operation for locating the holding mechanism 260 at the holding position.

Subsequently, the control part 203 normally rotates the motor 301 (S3). Then, the one-way clutch 252 rotates idly to allow the engagement member 251 to rotate in the counterclockwise direction as indicated in FIG. 9A. That is, when the motor 301 does not rotate during energization of the motor 301, the rotary shaft 232*a* drive-coupled to the motor 301 remains stopped. The one-way clutch 252 is provided between the rotary shaft 232*a* and the engagement member 251 to lock the rotation of the engagement member 251 in the counterclockwise direction as indicated in FIG. 9A relative to the rotary shaft 232*a*. That is, when the rotary shaft 232*a* tends to rotate in the clockwise direction relative to the engagement member 251, in other words, when the engagement member 251 tends to rotate in the counterclockwise direction relative to the rotary shaft 232*a*, the one-way clutch 252 is locked to allow transmission of rotation between the rotary shaft 232*a* and the engagement member 251. Thus, the engagement member 251 cannot rotate in the counterclockwise direction unless the motor 301 is rotated reversely to rotate the rotary shaft 232*a* in the counterclockwise direction.

When the motor 301 is thus normally rotated to allow the engagement member 251 to rotate in the counterclockwise direction as indicated in FIG. 9A, the pickup roller 231 supported by the support plate 240 swings in a direction from the first retracting position toward the feeding position by its own weight and the biasing force of the biasing spring 280 (FIGS. 10A and 10B). At this time, the engagement member 251 rotates in the counterclockwise direction indicated in FIG. 9A with the swing of the support plate 240 caused due to engagement between the retracting engagement part 254 and the support plate side engagement part 242.

Figure 17:
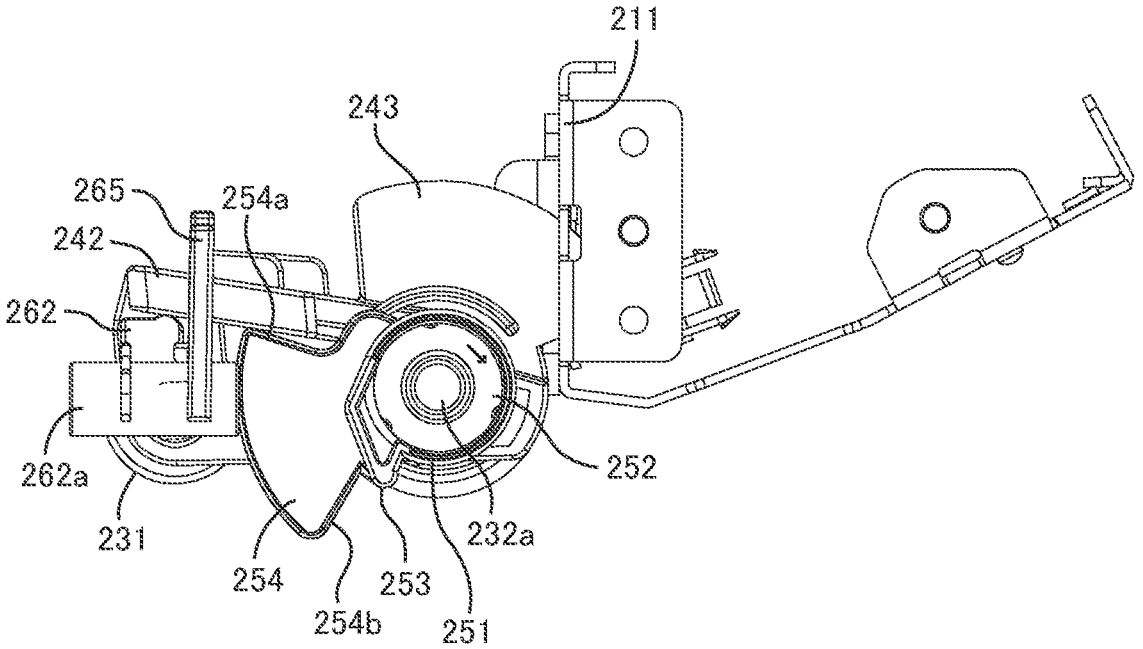
FIG. 17 is a side view illustrating a state where the feeding part has moved to a second retracting position from the first retracting position.

The pickup roller 231 supported by the support plate 240 swings to a second retracting position (S4) as illustrated in FIG. 17. The second retracting position refers to a position lying between the first retracting position and the feeding position, where the pickup roller 231 does not contact the uppermost sheet even when the amount of sheets stored in the sheet storage part 220 is maximum. At this second retracting position, the rotary axis of the pickup roller 231 is positioned vertically below the rotary axis (swing center of the swing shaft) of the conveying roller 232.

At this time, the solenoid 261 is kept turned ON, and the holding lever 262 remains lifting the swing lever 271. As described above, the first engagement part 263 that can be engaged with the support plate side engagement part 242 is provided at the leading end portion of the holding lever 262. The surface of the first engagement part 263 that is engaged with the support plate side engagement part 242 in a state where the holding lever 262 is lifted upward has a slope which becomes substantially horizontal.

Figure 18:
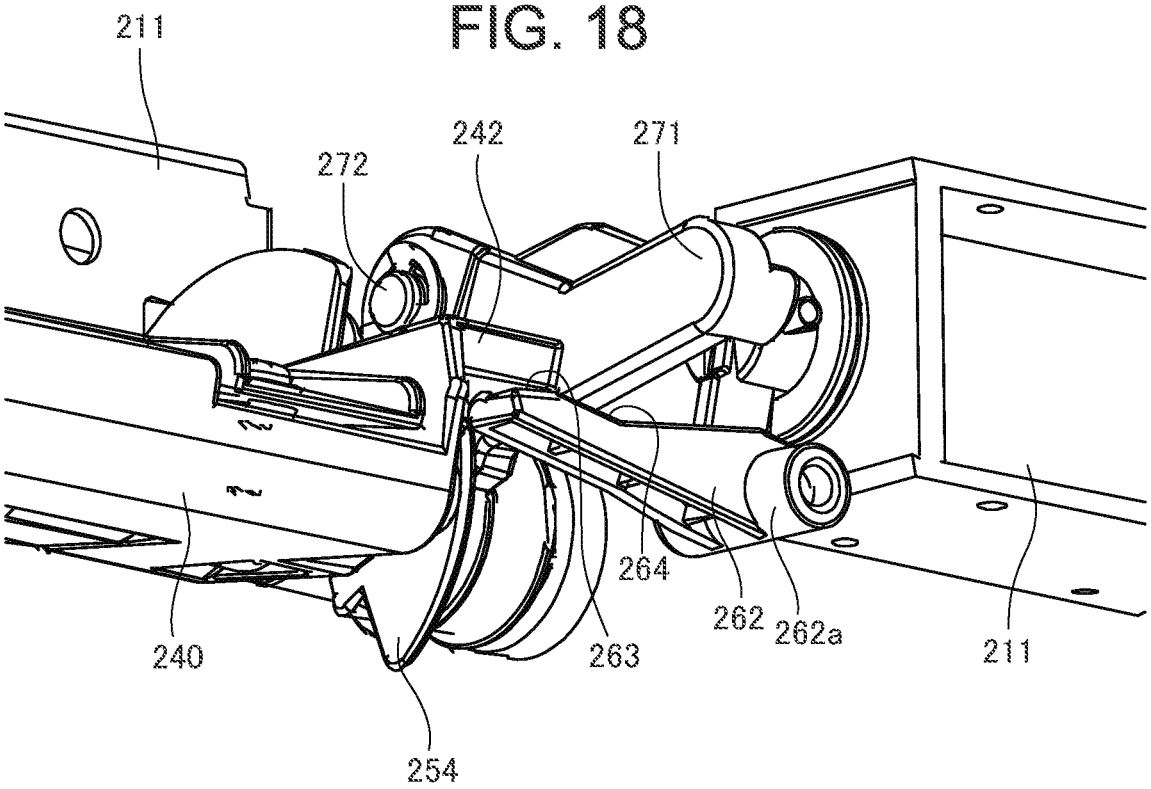
FIG. 18 is a perspective view illustrating a state where the feeding part is stopped at the second retracting position.

Thus, as described above, when the pickup roller 231 supported by the support plate 240 swings to the second retracting position, the first engagement part 263 of the holding lever 262 is engaged with the support plate side engagement part 242 of the support plate 240 to hold the pickup roller 231 at the second retracting position, as illustrated in FIGS. 17 and 18. That is, the holding lever 262 is configured to be able to hold the pickup roller 231 at the second retracting position in a state where the solenoid 261 is turned ON.

Figure 19A:
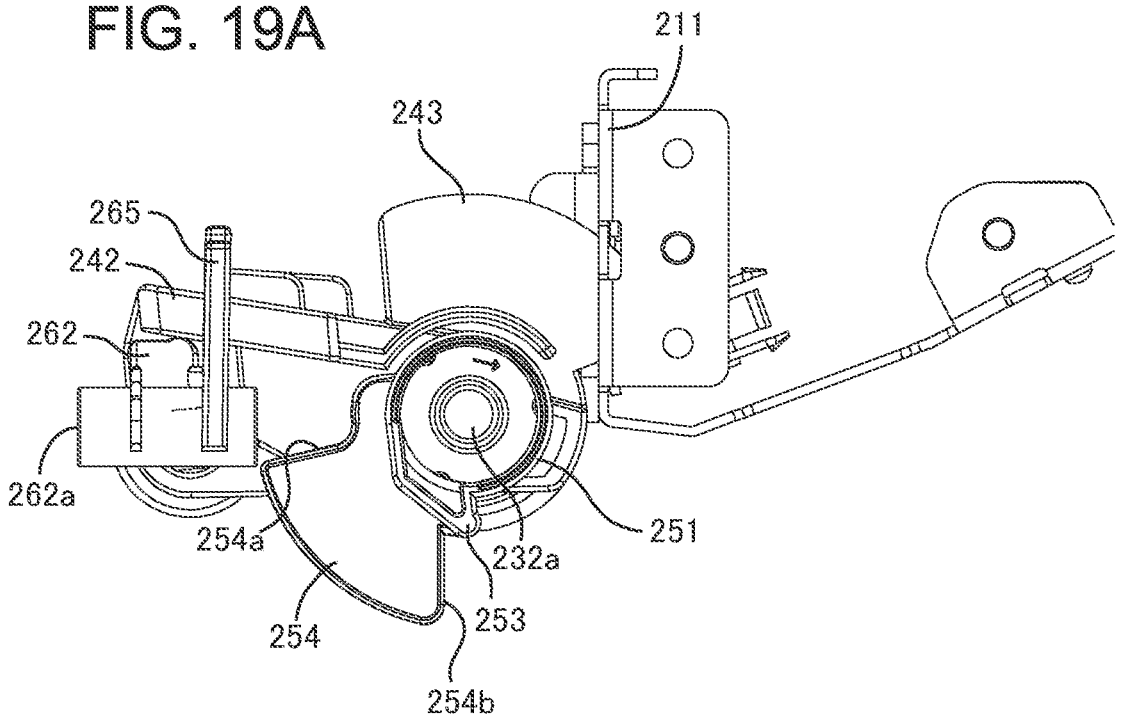
FIGS. 19A and 19B are a side view and a perspective view, respectively, each illustrating the second retracting position of the feeding part.
Figure 19B:
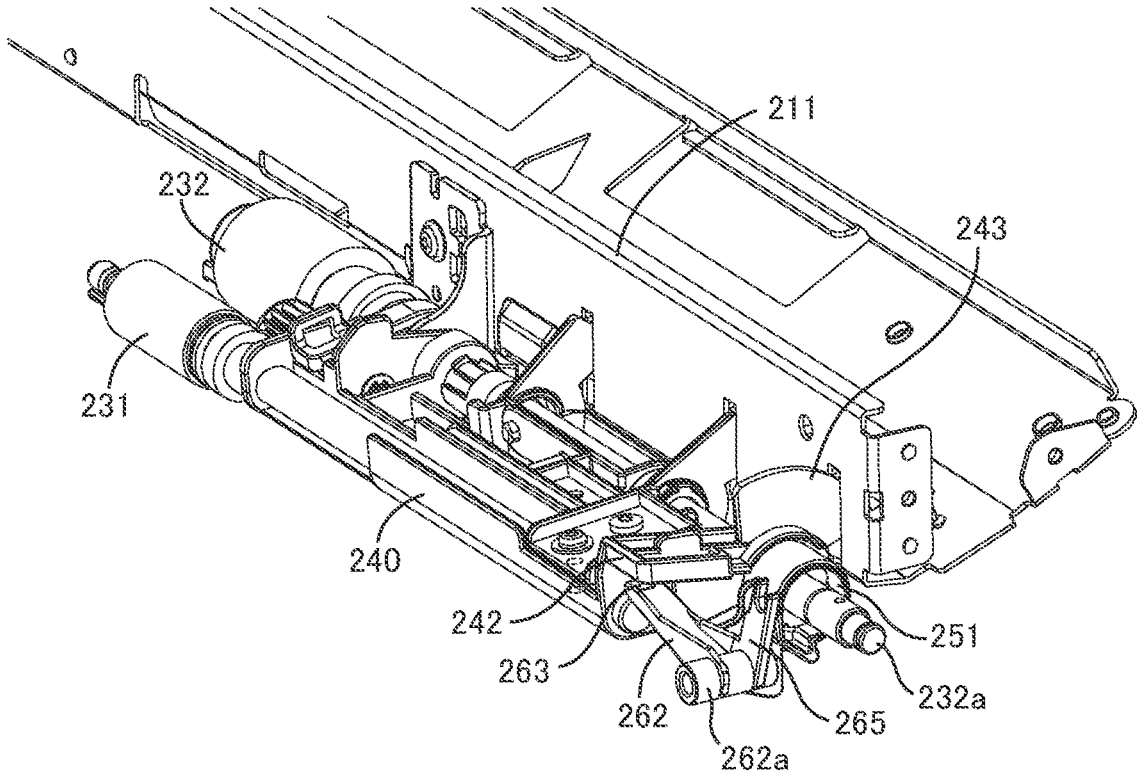

The control part 203 further normally rotates the motor 301 in a state where the pickup roller 231 is held at the second retracting position. Then, as illustrated in FIGS. 19A and 19B, the engagement member 251 rotates in the counterclockwise direction as indicated in FIG. 19A to release the engagement between the retracting engagement part 254 and the support plate side engagement part 242. That is, the control part 203 normally rotates the motor 301 by a predetermined amount in a state where the pickup roller 231 is held at the second retracting position. Specifically, the control part 203 continues rotating the motor 301 such that the retracting engagement part 254 separates by a sufficient distance from the support plate side engagement part 242 and moves to a predetermined position allowing the pickup roller 231 supported by the support plate 240 to move to the feeding position. In the present embodiment, the motor 301 is a pulse motor, so that the above predetermined amount is expressed by the number of pulses. Even when the motor 301 is a DC motor, it is possible to control the predetermined amount of rotation by providing an encoder capable of detecting a motor rotation amount.

As described above, the engagement member 251 allows the pickup roller 231 to move to the feeding position when the motor 301 normally rotates in a state where the pickup roller 231 is held at the second retracting position. Even in this state, the pickup roller 231 is held at the second retracting position by the holding lever 262. Then, after rotation of the engagement member 251 to a predetermined position, the rotation of the motor 301 is stopped (S5).

Figure 8B:
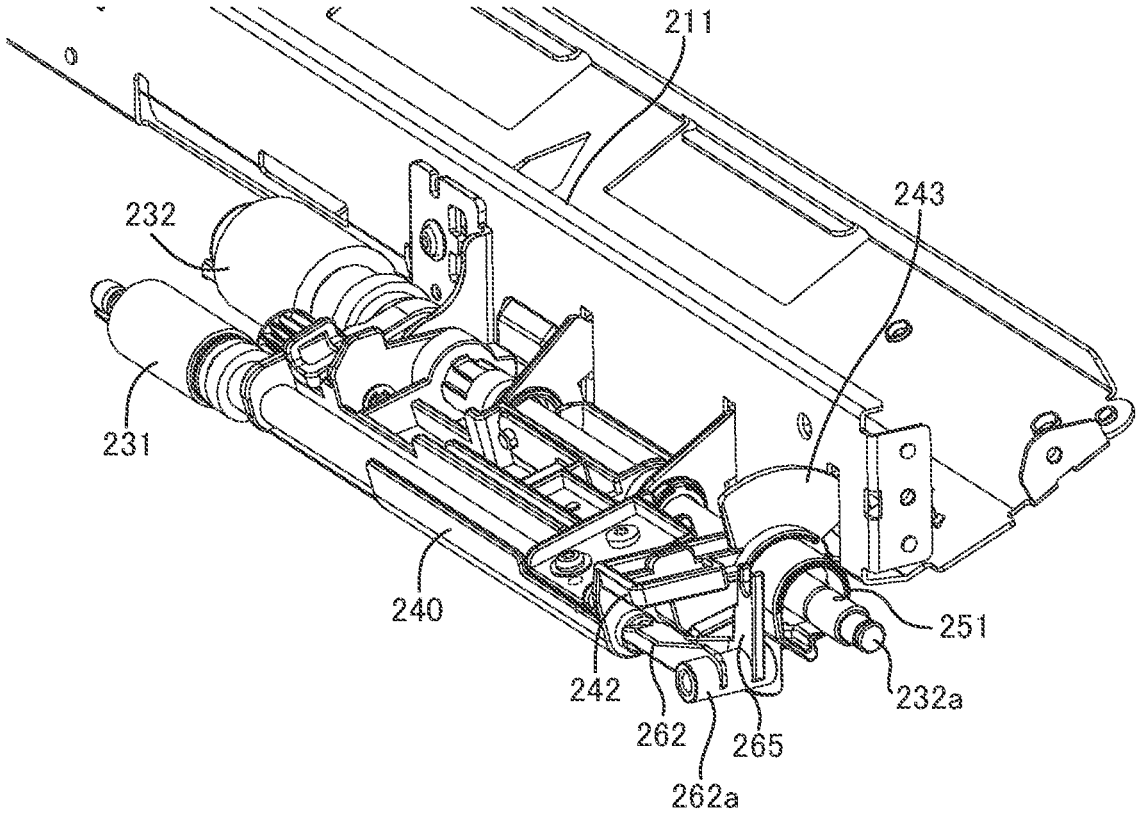

After stopping the drive of the motor 301, the control part 203 turns OFF the solenoid 261 (S6). Then, as illustrated in FIGS. 8A and 8B, the holding lever 262 swings downward about the swing shaft 262*a* and, accordingly, the support plate 240 also swings downward by its own weight and biasing force of the biasing spring 280, with the result that the pickup roller 231 supported by the support plate 240 moves to the feeding position. The retracting engagement part 254 of the engagement member 251 has a stopper surface 254*b* on the side opposite the retracting side engagement surface 254*a*. The stopper surface 254*b* is configured to be engaged with a not-shown stopper provided to the enclosure 204 so as to prevent the engagement member 251 from rotating excessively.

As described above, in the present embodiment, when the pickup roller 231 is moved from the first retracting position to the feed position in a state where the storage case 210 is attached to a predetermined attachment position, it is held once at the second retracting position in the enclosure 204. Then, after the stop of the drive of the motor 301, the pickup roller 231 is moved from the second retracting position to the feeding position. Thus, it is possible to prevent the pickup roller 231 from moving to the feeding position while rotating. This suppresses positional displacement of the sheet fed from the storage case 210.

In the above description, when moving the pickup roller 231 supported by the support plate 240 from the first retracting position to the feeding position, the pickup roller 231 supported by the support plate 240 is held once at the second retracting position, and this holding state is released after the rotation of the motor 301 is stopped. However, when moving the pickup roller 231 supported by the support plate 240 from the second retracting position to the feeding position, it may be selected whether the pickup roller 231 is moved after the motor 301 is stopped or while the motor 301 is being driven. To this end, a switching part 207 (see FIG. 13) allowing such a selection is provided in the multi-stage feeder 200.

For example, in response to an operation to the above switching part 207, the control part 203 turns ON the solenoid 261 to release the lock of the pickup roller 231 at the first retracting position, normally rotates the motor 301, and turns OFF the solenoid 261 while driving the motor 301. Thus, the pickup roller 231 supported by the support plate 240 moves to the first retracting position without stopping at the second retracting position. Since the motor 301 remains normally rotating at this time, the pickup roller 231 moves to the feeding position while rotating. This offers a wider variety of operator's operations. For example, when the sheet loading amount is not large, it is possible to move the pickup roller 231 to the feeding position as fast as possible by operating the switching part 207 as described above.

In the above embodiment, the control part 203 for controlling the motor 301 and solenoid 261 is provided in the multi-stage feeder 200; however, the above control may be realized by the control part 140 of the image forming apparatus 100. Further, the sheet feeding apparatus is not limited to the above multi-stage feeder, but may be of other configurations, such as a single deck configuration.

This application claims the priority on Japanese Patent Application No. 2019-239939 filed on Dec. 27, 2019, the entire contents of which is incorporated herein by reference.

What is claimed is:

1. A sheet feeding apparatus for feeding a sheet, comprising:

a storage part that stores a sheet;

a feeding roller that feeds the sheet stored in the storage part;

a drive motor that moves the feeding roller, by a forward rotation thereof, from a feeding position where the feeding roller contacts and feeds the sheet stored in the storage part to a first retracting position where the feeding roller is separated from the sheet stored in the storage part, and allows movement of the feeding roller, by a reverse rotation thereof, from the first retracting position toward the feeding position by a weight of the feeding roller;

a holding member that stops and holds the feeding roller at a second retracting position lying between the first retracting position and the feeding position when the drive motor moves the feeding roller from the first retracting position toward the feeding position; and an actuator that moves the holding member to a holding position that holds the feeding roller, and a holding release position that releases holding of the feeding roller.

2. The sheet feeding apparatus according to claim 1, wherein the holding member stops and holds the feeding roller moved by the drive motor at the second retracting position and releases the hold of the feeding roller after a drive of the moving member is stopped.

3. The sheet feeding apparatus according to claim 1, further comprising a support member that supports the feeding roller and moves together with the feeding roller, and an engagement member having an engagement part which is engaged with a part of the support member by the reverse rotation of the drive motor to move the feeding roller from the feeding position to the first retracting position, wherein when the drive motor normally rotates in a state where the holding member holds the feeding roller at the second retracting position, an engagement between the engagement part of the engagement member and the part of the support member is released to allow the feeding roller to move to the feeding position.

4. The sheet feeding apparatus according to claim 3, further comprising a lock mechanism capable of locking the feeding roller at the first retracting position, wherein the holding member is switched between the holding position where it holds the feeding roller at the second retracting position and the holding release position where it releases a hold of the feeding roller, and the lock mechanism releases the lock of the feeding roller by a switching operation of the holding member to the holding position.

5. The sheet feeding apparatus according to claim 1, further comprising:

an enclosure from and into which the storage part is withdrawn and inserted; and a connection part that connects the drive motor and the feeding roller in a state where the storage part is inserted into the enclosure so as to allow a drive of the drive motor to be transmitted to the feeding roller and releases a drive connection between the drive motor and the feeding roller when the storage part is withdrawn from the enclosure.

6. The sheet feeding apparatus according to claim 5, further comprising:

an operation part for withdrawing the storage part; and a control part for controlling the drive motor, wherein upon an operation on the operation part, the control part reversely rotates the drive motor before the storage part is withdrawn to move the feeding roller from the feeding position to the first retracting position.

7. The sheet feeding apparatus according to claim 3, wherein the drive motor is configured to normally and reversely rotate an engagement member, and the engagement member reversely rotates to move the feeding roller from the feeding position to the first retracting position and normally rotates to move the feeding roller from the first retracting position to the feeding position.

* * * * *